US011598236B2

(12) United States Patent
Reytsman et al.

(10) Patent No.: US 11,598,236 B2
(45) Date of Patent: Mar. 7, 2023

(54) EXHAUST SYSTEM

(71) Applicant: Ford Global Technologies, LLC, Dearborn, MI (US)

(72) Inventors: Michael Reytsman, Ann Arbor, MI (US); Ya-Juan Bemman, Dearborn, MI (US); Patrick Fleming, Dearborn, MI (US); Alfredo Salgado, Dearborn, MI (US); Christopher Venglar, Dearborn, MI (US); Raymond Morelli, Jr., Perrysburg, OH (US); Omar Yuren Mendoza Bravo, Cuautitlan Izcalli (MX); Athanasios K. Teknos, Rochester Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 360 days.

(21) Appl. No.: 17/034,151

(22) Filed: Sep. 28, 2020

(65) Prior Publication Data

US 2022/0099007 A1 Mar. 31, 2022

(51) Int. Cl.
*F01N 1/16* (2006.01)
*G10K 11/16* (2006.01)

(52) U.S. Cl.
CPC ..... *F01N 1/166* (2013.01); *G10K 11/161* (2013.01); *F01N 2470/14* (2013.01); *F01N 2470/16* (2013.01)

(58) Field of Classification Search
CPC ..... F01N 2410/10; F01N 2470/14; F01N 2470/16; F01N 13/02; F01N 13/04; F01N 1/166; G10K 11/161
USPC ..... 181/253
See application file for complete search history.

(56) References Cited

U.S. PATENT DOCUMENTS

| | | | | |
|---|---|---|---|---|
| 2,996,139 | A * | 8/1961 | Patterson | F01N 1/08 181/239 |
| 6,247,305 | B1 * | 6/2001 | Bassani | F02B 27/04 181/227 |
| 7,596,944 | B2 * | 10/2009 | Mueller | F01N 13/1872 60/272 |
| 7,703,574 | B2 * | 4/2010 | Kruger | F01N 13/011 181/254 |
| 7,971,433 | B2 * | 7/2011 | Kabat | F01N 3/2066 60/287 |
| 8,209,972 | B2 * | 7/2012 | Tuch | F01N 13/1888 60/272 |
| 2017/0058733 | A1 * | 3/2017 | Peters | F01N 1/168 |
| 2017/0362976 | A1 * | 12/2017 | Solferino | F01N 1/02 |
| 2018/0202344 | A1 * | 7/2018 | Klemenc | F01N 1/166 |
| 2019/0338690 | A1 * | 11/2019 | Herwat | F01N 13/08 |
| 2020/0149456 | A1 | 5/2020 | Smiljanovski et al. | |
| 2020/0191039 | A1 * | 6/2020 | Borla | F01N 13/08 |

* cited by examiner

*Primary Examiner* — Jeremy A Luks
(74) *Attorney, Agent, or Firm* — Vincent Mastrogiacomo; McCoy Russell LLP

(57) ABSTRACT

Exhaust systems for a vehicle are provided. In one example, an exhaust system includes a muffler, a first exhaust outlet pipe fluidly coupled to a first outlet of the muffler, a second exhaust outlet pipe fluidly coupled to a second outlet of the muffler, a bypass duct fluidly coupled to a third outlet of the muffler, and a combined X-Y shaped intersection at which the first exhaust outlet pipe, the second exhaust outlet pipe, and the bypass duct are fluidly coupled to each other.

20 Claims, 11 Drawing Sheets

EXHAUST SYSTEM

FIELD

The present description relates generally to an exhaust system for a vehicle, and more specifically to exhaust outlet pipes fluidly coupling a muffler to one or more tailpipes.

BACKGROUND/SUMMARY

Exhaust systems for vehicles typically include a muffler to attenuate exhaust noise. After traveling through the muffler, the exhaust gas may flow to a tailpipe via a main exhaust outlet pipe. During some modes of operation, it may be desirable to an operator of the vehicle to modulate the exhaust noise, and thus some exhaust systems include an active exhaust valve that, when closed, causes exhaust gas exiting the muffler to flow through a bypass duct rather than the main exhaust outlet pipe. The bypass duct may have a smaller cross-sectional area than the main exhaust outlet pipe, and thus may reduce exhaust noise relative to the exhaust noise generated when the exhaust gas flows primarily through the main exhaust pipe.

Certain vehicles, such as vehicles designed for high power operation (e.g., towing) may include a relatively high number of cylinders (e.g., 8, 12, etc.) and thus the exhaust systems of such vehicles may include two main exhaust pipes to accommodate the large volume of exhaust gas generated by the engine. In these exhaust systems, the outlet side of the muffler may be fluidly coupled to the two main exhaust pipes (each including an active exhaust valve) and two bypass ducts, and the positions of the active exhaust valves may be adjusted to provide desired exhaust noise characteristics.

However, the inventors herein have recognized potential issues with such exhaust systems. As one example, the four outlets of the muffler leading to four exhaust pipes (e.g., the two main exhaust pipes and the two bypass ducts) may result in a heavy exhaust system that lowers fuel economy and is costly to manufacture.

In one example, the issues described above may be addressed by an exhaust system including a muffler, a first exhaust outlet pipe fluidly coupled to a first outlet of the muffler, a second exhaust outlet pipe fluidly coupled to a second outlet of the muffler, a bypass duct fluidly coupled to a third outlet of the muffler, and a combined X-Y shaped intersection at which the first exhaust outlet pipe, the second exhaust outlet pipe, and the bypass duct are fluidly coupled to each other.

As one example, each of the first exhaust outlet pipe and the second exhaust outlet pipe may include a respective active exhaust valve upstream of the X-Y shaped intersection that may be adjusted to allow or block exhaust gas flow through the corresponding exhaust outlet pipe, in order to adjust the proportion of the exhaust gas that flows through the bypass duct and thereby produce desired exhaust sound. The exhaust system includes the single bypass duct that couples to both the first exhaust outlet pipe and the second exhaust outlet pipe at the X-Y shaped intersection. The X-Y shaped intersection includes an X-pipe/intersection that is configured to allow exhaust gas mixing between exhaust gas flowing through the first exhaust outlet pipe and exhaust gas flowing through the second exhaust outlet pipe, which may dampen exhaust gas pulsations, increase engine power, and/or promote desired exhaust sound characteristics. The bypass duct may couple to the X-pipe to form a Y-shaped portion of the X-Y shaped intersection. By including only a single bypass duct (e.g., rather than two separate bypass ducts) and joining the single bypass duct to the exhaust outlet pipes at the X-Y shaped intersection, exhaust system component weight may be lowered and manufacturing costs may be decreased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-12 are shown approximately to scale, although other relative dimensions could be used.

DETAILED DESCRIPTION

Figure 1:
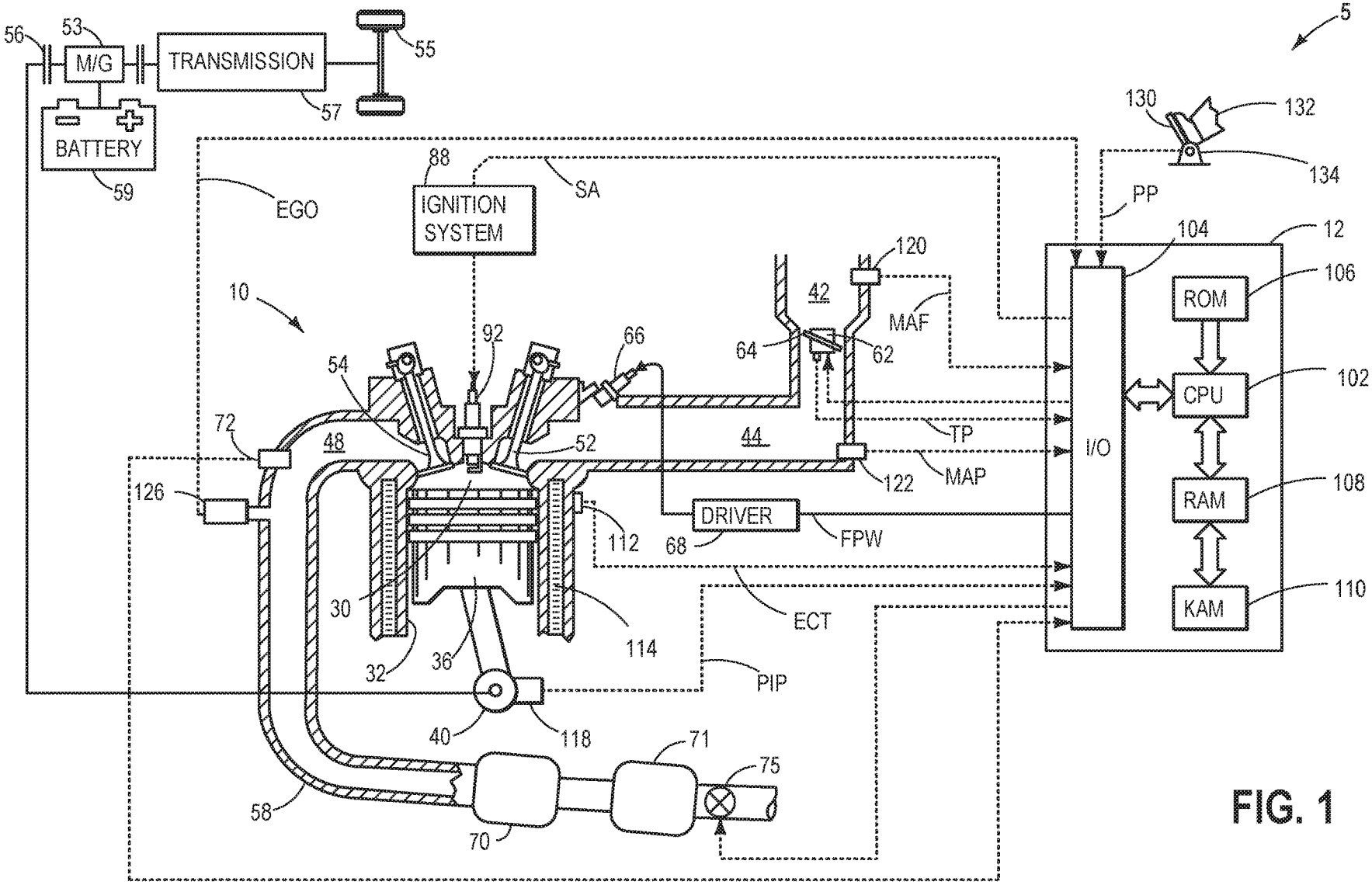
FIG. 1 schematically shows an example engine with an exhaust system.
Figure 2:
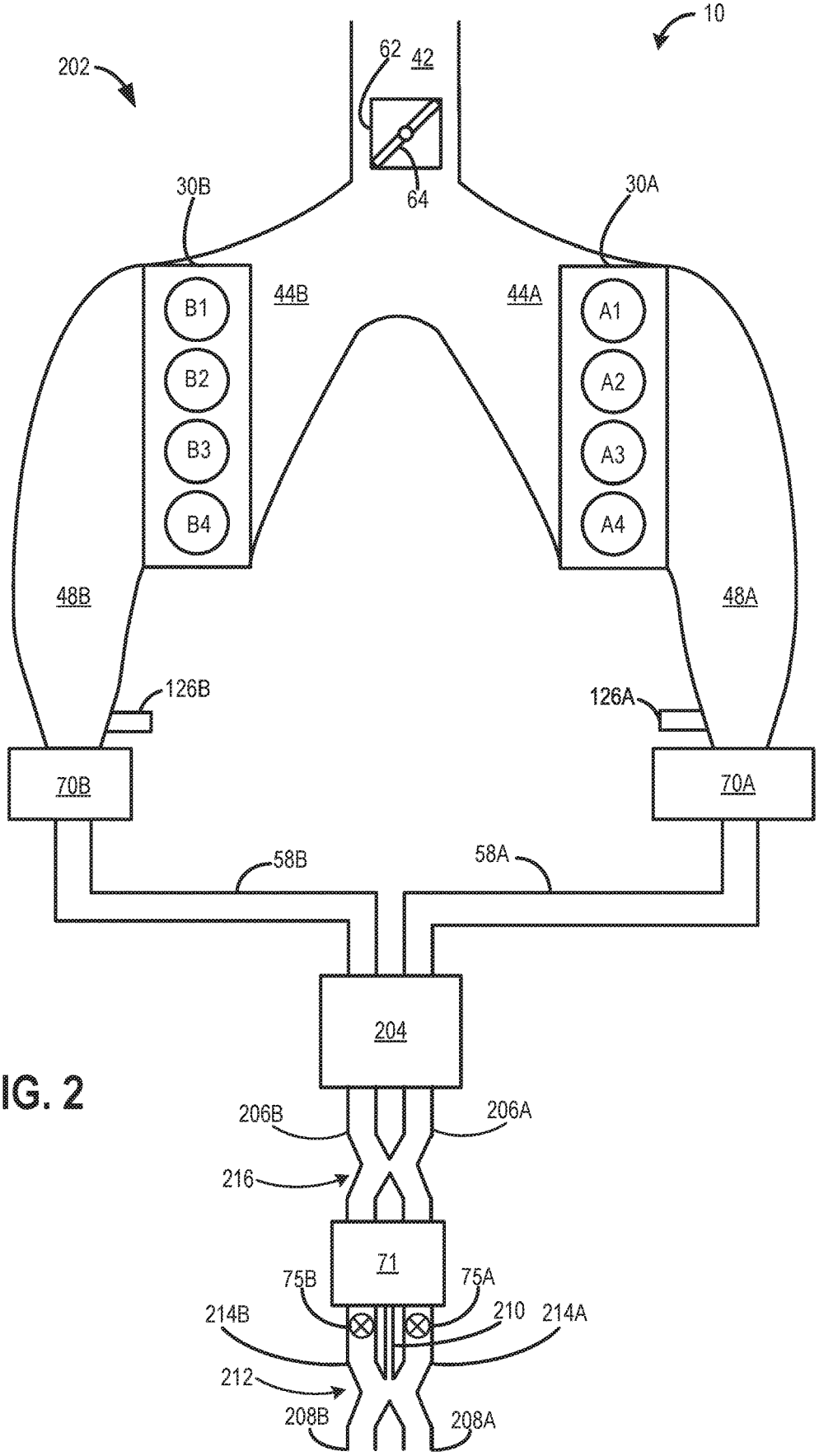
FIG. 2 schematically shows an example V-engine with a dual bank exhaust system.

The following description relates to an exhaust system of a vehicle, such as the vehicle shown in FIG. 1. The exhaust system includes a 2-in, 3-out muffler, as shown in FIG. 2. The 2-in, 3-out muffler is fluidly coupled on an inlet side of the muffler to two exhaust passages leading from an engine. The muffler is fluidly coupled on an outlet side of the muffler to two exhaust pipes (that eventually lead to respective tailpipes) and a single bypass duct that allows for bypass of exhaust gas around active exhaust valves positioned in the two exhaust pipes. As shown in FIGS. 3-12, the bypass duct may terminate at and fluidly couple to the two exhaust pipes at an X-Y shaped intersection, where exhaust gas flowing through the two exhaust pipes and/or the bypass duct may mix. By relying in a single bypass duct rather than two separate bypass ducts and joining the bypass duct at an X-pipe between the two exhaust pipes, the X-Y shaped intersection of the disclosure may be manufactured with a single stamping process to form the X-Y shaped intersection, which may be lower in cost than the tooling/stamping required to produce two separate Y-pipes. The X-Y shaped intersection and use of a single bypass duct may also lower exhaust system weight, which may improve fuel economy and reduce vehicle vibration. Further, the use of the 2-in, 3-out muffler with the X-Y shaped intersection (as opposed to a 2-in, 4-out muffler with two Y-pipes) may allow for a lighter and lower cost muffler while still providing the same acoustic characteristics of the exhaust gas.

Turning to FIG. 1, a schematic diagram of one cylinder of multi-cylinder engine 10, which may be included in a propulsion system of a vehicle 5, is shown. Vehicle 5 may be configured for on-road propulsion. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber 30 (also termed cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust manifold 48. Exhaust manifold 48 may include a temperature sensor 72. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves.

Fuel injector 66 is shown arranged in intake manifold 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 coupled upstream of throttle 62 for measuring the flow rate of aircharge entering into the cylinder through throttle 62. Intake passage 42 may also include a manifold air pressure sensor 122 coupled downstream of throttle 62 for measuring manifold air pressure MAP.

In some embodiments, a compression device, such as a turbocharger or supercharger, including at least a compressor (not shown), may be arranged along intake manifold 44. For a turbocharger, the compressor may be at least partially driven by a turbine (not shown), for example via a shaft, the turbine arranged along exhaust manifold 48. For a supercharger, the compressor may be at least partially driven by the engine and/or an electric machine, and may not include a turbine.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 58 upstream of emission control device 70. Sensor 126 may be any suitable sensor for providing an indication of exhaust gas air-fuel ratio such as a linear oxygen sensor or UEGO (universal or wide-range exhaust gas oxygen), a narrow band (older systems treat as a two-state device) oxygen sensor or EGO, a HEGO (heated EGO), a NOx, HC, or CO sensor. Emission control device 70 is shown arranged along exhaust passage 58 downstream of exhaust gas sensor 126. The emission control device 70 may be a three way catalyst (TWC), SCR catalyst, NOx trap, a gasoline particulate filter (GPF), a combination of two or more of these devices, or one of various other emission control devices.

Further, engine 10 may include an exhaust gas recirculation (EGR) system (not shown) to help lower NOx and other emissions. The EGR system may be configured to recirculate a portion of exhaust gas from the engine exhaust to the engine intake. In one example, the EGR system may be a low pressure EGR system wherein exhaust gas is recirculated from downstream of gasoline particulate filter 70 to the engine intake.

The exhaust passage 58 may also include a muffler 71 and an active exhaust valve 75 (also referred to as an exhaust tuning valve) arranged downstream of the muffler 71. The exhaust passage 58 may also be referred to herein as an exhaust duct or exhaust pipe and may terminate at an exterior of the vehicle 5 as a (or coupled to) a tailpipe. The active exhaust valve 75 may be controlled via signals from controller 12 in order to provide desired exhaust sound characteristics, as will be explained in more detail below.

The oxygen sensor(s) of vehicle 5 may be linear oxygen sensors or switching oxygen sensors. As an example, the oxygen sensors may be one of a UEGO sensor (universal or wide-range exhaust gas oxygen), a two-state oxygen sensor or EGO sensor, or a HEGO (heated EGO) sensor. Exhaust gas oxygen sensors 126 may assess a concentration of oxygen present in the exhaust gas and sense tailpipe exhaust oxygen concentrations about the emission control device 70. Exhaust gas sensor 126 may be a feed-gas oxygen sensor positioned upstream of emission control device 70 configured to sense feed-gas exhaust oxygen concentrations.

The air-fuel ratio of exhaust released from cylinders 30 may be determined by one or more of the oxygen sensors located in the exhaust stream of the engine. Based on the estimated exhaust air-fuel ratio, fuel injection to engine cylinders may be adjusted so as to control the air-fuel ratio of cylinder combustion. For example, fuel injection amounts to the cylinders may be adjusted based on a deviation of the exhaust air-fuel ratio, estimated based on the output of exhaust gas sensor 126 and a desired air-fuel ratio (such as a deviation from stoichiometry).

Vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 53. Electric machine 53 may be a motor or a motor/generator. Crankshaft 140 of engine 10 and electric machine 53 are connected via a transmission 57 to vehicle wheels 55 when one or more clutches 56 are engaged. In the depicted example, a first clutch 56 is provided between crankshaft 140 and electric machine 53, and a second clutch 56 is provided between electric machine 53 and transmission 57. Controller 12 may send a signal to an actuator of each clutch 56 to engage or disengage the clutch, so as to connect or disconnect crankshaft 140 from electric machine 53 and the components connected thereto, and/or connect or disconnect electric machine 53 from transmission 57 and the components connected thereto. Transmission 57 may be a gearbox, a planetary gear system, or another type of transmission. The powertrain may be configured in various manners including as a parallel, a series, or a series-parallel hybrid vehicle.

Electric machine 53 receives electrical power from a traction battery 59 to provide torque to vehicle wheels 55. Electric machine 53 may also be operated as a generator to provide electrical power to charge battery 59, for example during a braking operation.

Controller 12 is shown in FIG. 1 as a microcomputer, including microprocessor unit 102, input/output ports 104, an electronic storage medium for executable programs and calibration values shown as read only memory 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; exhaust temperature in the exhaust manifold from sensor 72, and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses for each revolution of the crankshaft. Additionally, controller 12 may communicate with a cluster display device, for example to alert the driver of faults in the engine or exhaust system.

Storage medium read-only memory 106 can be programmed with computer readable data representing instructions executable by processor 102 for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller. For example, adjusting fuel injection may include adjusting pulse width signal FPW to electronic driver 68 to adjust the amount of fuel injected to the cylinder via fuel injector 66.

Turning to FIG. 2, an example version of engine 10 that includes multiple cylinders arranged in a V configuration (e.g., V-Engine) is shown as V-engine 10. Engine 10 includes a plurality of combustion chambers or cylinders 30. The plurality of cylinders 30 of engine 10 are arranged as groups of cylinders on distinct engine banks. In the depicted example, engine 10 includes two engine cylinder banks 30A, 30B. Thus, the cylinders 30 are arranged as a first group of cylinders (four cylinders in the depicted example) arranged on first engine bank 30A and labeled A1-A4, and a second group of cylinders (four cylinders in the depicted example) arranged on second engine bank 30B labeled B1-B4. It will be appreciated that while the example depicted in FIGS. 1-2 shows a V-engine with cylinders arranged on different banks, this is not meant to be limiting, and in alternative examples, the engine may be an in-line engine with all engine cylinders on a common engine bank.

Engine 10 may receive intake air via an intake passage 42 communicating with branched intake manifold 44A, 44B. Specifically, first engine bank 30A receives intake air from intake passage 42 via a first intake manifold 44A while second engine bank 30B receives intake air from intake passage 42 via second intake manifold 44B. While engine banks 30A, 30B are shown with a common intake manifold, it will be appreciated that in alternative examples, the engine may include two separate intake manifolds. The amount of air supplied to the cylinders of the engine can be controlled by adjusting a position of throttle 62 on throttle plate 64. Additionally, an amount of air supplied to each group of cylinders on the specific banks can be adjusted by varying an intake valve timing of one or more intake valves coupled to the cylinders.

Combustion products generated at the cylinders of first engine bank 30A are directed to one or more emission control devices in first exhaust manifold 48A where the combustion products are treated before being vented to the atmosphere. A first emission control device 70A is coupled to first exhaust manifold 48A. First emission control device 70A may include one or more exhaust catalysts. Exhaust gas generated at first engine bank 30A is treated at emission control device 70A Combustion products generated at the cylinders of second engine bank 30B are exhausted to the atmosphere via second exhaust manifold 48B. A second emission control device 70B is coupled to second exhaust manifold 48B. Second emission control device 70B may include one or more exhaust catalysts. Exhaust gas generated at second engine bank 30B is treated at emission control device 70B.

While FIG. 2 shows each engine bank coupled to respective underbody emission control devices, in alternative examples, each engine bank may be coupled to respective emission control devices 70A, 70B but to a common underbody emission control device positioned downstream in a common exhaust passageway.

Various sensors may be coupled to engine 10. For example, a first exhaust gas sensor 126A may be coupled to the first exhaust manifold 48A of first engine bank 30A, upstream of first emission control device 70A while a second exhaust gas sensor 126B is coupled to the second exhaust manifold 48B of second engine bank 30B, upstream of second emission control device 70B. In further examples, additional exhaust gas sensors may be coupled downstream of the emission control devices. Still other sensors, such as temperature sensors, may be included, for example, coupled to the underbody emission control device(s). As elaborated in FIG. 2, the exhaust gas sensors 126A and 126B may include exhaust gas oxygen sensors, such as EGO, HEGO, or UEGO sensors.

As shown in FIG. 2, the exhaust passages 58A, 58B of each bank may converge at a resonator 204. However, in alternative embodiments, the resonator may not be included in engine 10. After the resonator 204, the exhaust flow is split up into a first exhaust pipe 206A (on the first engine bank side) and a second exhaust pipe 206B (on the second engine bank side), which may be continuations of the respective exhaust passages. The first exhaust pipe 206A and the second exhaust pipe 206B may intersect and then separate downstream, forming an X-shaped intersection 216. The X-shaped intersection 216 may also be referred to as an X-pipe. The X-shaped intersection 216 may allow exhaust gas pulses in the first exhaust pipe 206A and the second exhaust pipe 206B to mix, which may reduce exhaust backpressure and increase engine power. Further, the exhaust gas flow through the X-shaped intersection 216 may result in different exhaust noise characteristics than two straight exhaust pipes.

Downstream of the X-shaped intersection 216, the first exhaust pipe 206A and the second exhaust pipe 206B are separately coupled to a muffler 71. The exhaust gas flowing out of the first exhaust pipe 206A and the second exhaust pipe 206B may flow through and interact with components of the muffler 71 (e.g., chambers, baffles, etc.), and exit the muffler 71 via a set of three pipes: a first outlet pipe 214A, a second outlet pipe 214B, and a bypass duct 210. The first outlet pipe 214A may comprise a first active exhaust valve 75A, and the second outlet pipe 214B may comprise a second active exhaust valve 75B. The first outlet pipe 214A and the second outlet pipe 214B may fluidly intersect downstream of the first active exhaust valve 75A and second active exhaust valve 75B to form an intersection 212, and the first outlet pipe 214A and the second outlet pipe 214B may continue separately downstream of the intersection 212. The bypass duct 210 additionally fluidly couples at the intersection 212, thus forming an X-Y shaped intersection 212 between the three upstream passages and leading to two downstream passages. The bypass duct 210 may flow exhaust gas around the first active exhaust valve 75A and/or the second active exhaust valve 75B, depending on the positions of the first active exhaust valve 75A and the second active exhaust valve 75B, as will be described in more detail below. Due to the smaller cross-sectional area of the bypass duct 210 relative to the first outlet pipe 214A and the second outlet pipe 214B, the noise characteristics of the exhaust gas may change when flowing through the bypass duct 210. By utilizing a single bypass duct 210 rather than two separate bypass ducts (e.g., one coupled around each active exhaust valve), the weight and complexity of the exhaust system may be reduced, which may reduce manufacturing costs and improve fuel efficiency. Further, by coupling the bypass duct 210 to the first outlet pipe 214A and the second outlet pipe 214B at the X-Y shaped intersection 212, exhaust gas flow may be improved and desired exhaust gas noise characteristics may be achieved. Because the exhaust system at the intersection 212 may comprise the joining of three upstream passages (the first outlet pipe 214A, the second outlet pipe 214B, and the bypass duct 210) as opposed to four upstream passages (e.g., two outlet pipes and two bypass ducts), the exhaust system may comprise fewer components, leading to manufacturing efficiency and cost gains. Additionally, the weight and maintenance of the exhaust system may be decreased, as fewer components may weigh less and provide fewer opportunities for degradation. The specific structure of the intersection of the first and second outlet pipes 214A and 214B with the bypass duct is discussed in the description of FIGS. 3-12.

When the first active exhaust valve 75A is open, exhaust exits the muffler 71 via the first active exhaust valve 75A, continues down the first outlet pipe 214A, and flows to a first outlet 208A (which may be coupled to a first tailpipe). In some conditions, the first active exhaust valve 75A may be partially or incompletely closed, thus allowing some exhaust to flow into the first outlet pipe 214A, but at a decreased rate and/or volume than if the first active exhaust valve 75A were completely open. The partial or complete closing of the first active exhaust valve 75A may increase the proportion of total exhaust which flows through the bypass duct 210, thereby lowering exhaust noise.

Similarly, when the second active exhaust valve 75B is open, exhaust exits the muffler 71 via the second active exhaust valve 75B, continues down the second outlet pipe 214B, and flows to a second outlet 208B (which may be coupled to a second tailpipe). In some conditions, the second exhaust valve 75B may be partially or incompletely closed, thus allowing some exhaust to flow into the second exhaust pipe 214B, but at a rate and/or volume that is lower than if the second exhaust valve 75B were completely open. This positioning may increase the proportion of total exhaust which flows through the bypass duct 210, thereby lowering exhaust noise.

The degree of openness of one active exhaust valve may affect the amount of exhaust gas passing through the other active exhaust valve and the bypass duct 210. For example, the amount of exhaust flow through the first active exhaust valve 75A may be related to the degree of openness of the second active exhaust valve 75B. In other words, if the first active exhaust valve 75A is more open than the second active exhaust valve 75B is, then more exhaust may pass through the first active exhaust valve 75A than passes through the second active exhaust valve 75B. The amount of exhaust flow through the second active exhaust valve 75B may be related to the degree of openness of the first active exhaust valve 75A. If the second active exhaust valve 75B is more open than the first active exhaust valve 75A, then more exhaust may flow through the second active exhaust valve 75B than flows through the first active exhaust valve 75A.

When the first active exhaust valve 75A and the second active exhaust valve 75B are both open, exhaust may flow primarily into the first outlet pipe 214A and second outlet pipe 214B. Because the first outlet pipe 214A and the second outlet pipe 214B may have larger diameters than the diameter of the bypass duct 210, the sound produced by the exhaust may be louder than the sound produced when the exhaust flows only or primarily through the bypass duct 210. Louder sound may be desired by the operator in some contexts.

When the first active exhaust valve 75A and the second active exhaust valve 75B are both fully closed, exhaust may exit the muffler 71 only via the bypass duct 210. Exhaust flow may be restricted by the diameter of the bypass duct 210 because the diameter of the bypass duct 210 may be narrower than the diameters of the first outlet pipe 214A and the second outlet pipe 214B. The restricted exhaust may lead to a dampened sound, which may be suitable for driving applications in which less noise is preferable.

The controller may adjust the positions of the first active exhaust valve 75A and the second active exhaust valve 75B (e.g., between open and closed) in order to control exhaust noise to a desired level (e.g., based on engine operating conditions and/or an operator-selected noise mode).

Thus, the proposed arrangement may allow for easier manufacturing, as the number of pipes is minimized when compared to other exhaust system designs such as a "two-in-four out" design, in which two bypass ducts are present and each bypass duct couples to a respective exhaust outlet pipe as part of a Y-pipe design. The decrease in parts additionally allows the exhaust system to be lighter, which may improve vehicle handling.

The inclusion of the bypass duct 210 allows for a variable noise production, which may be alterable based on the operator's desires. For example, the exhaust system may be tuned so as to produce the desired exhaust noise. However, in varying contexts, such as driving conditions in which less noise and quieter operation are desirable, the exhaust system may be manipulated to produce a quieter sound. Conversely, in other contexts, in which a louder exhaust tone is desired, the active valve exhaust system may be manipulated to produce a louder sound. The present design may allow for such flexibility in operation, while keeping cost and weight low.

In dual bank exhaust systems, as shown in FIG. 2, both active exhaust valves (e.g., valve 75A and valve 75B shown in FIG. 2), on the separate banks, may be controlled to behave uniformly to achieve uniform exhaust sound levels. For example, the two active exhaust valves may be commanded into a same position (e.g., open or closed) in order to achieve a desired and uniform exhaust sound level. In other examples, the active exhaust valves may be controlled in a separate manner, such that one valve may be closed while the other is opened.

Figure 3:
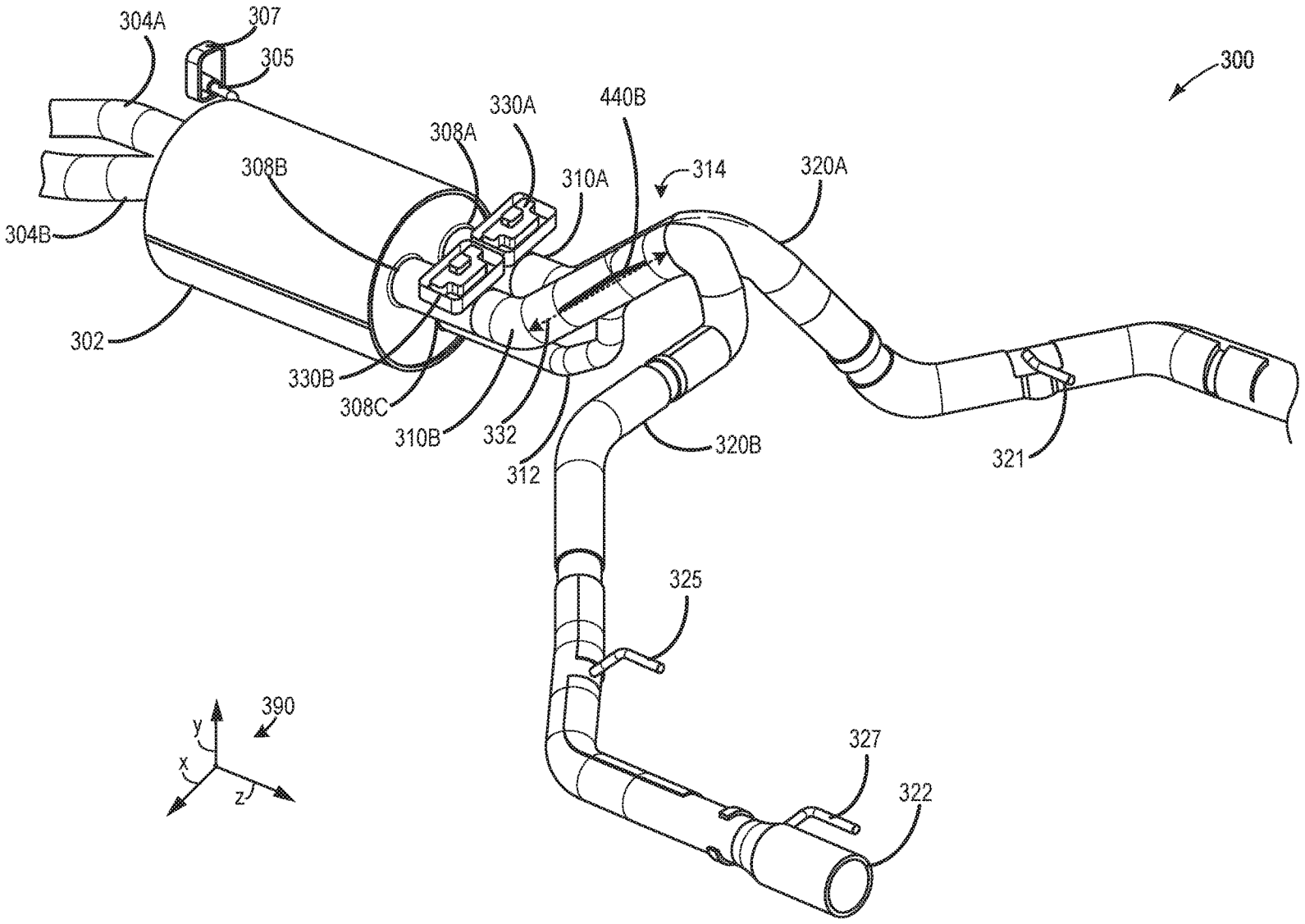
FIGS. 3-10 show an example exhaust system including a muffler and an X-Y shaped intersection.
Figure 4:
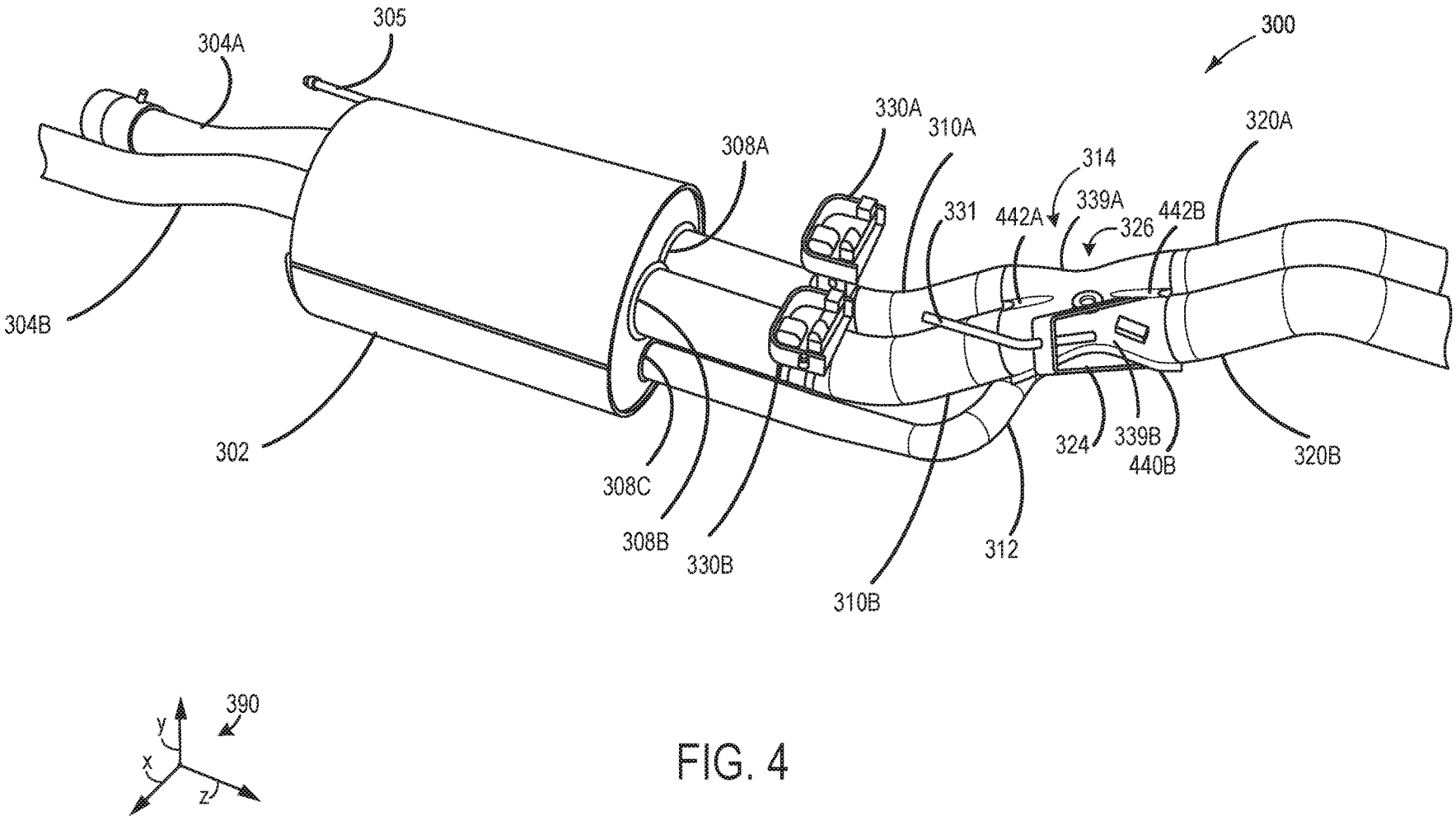
Figure 5:
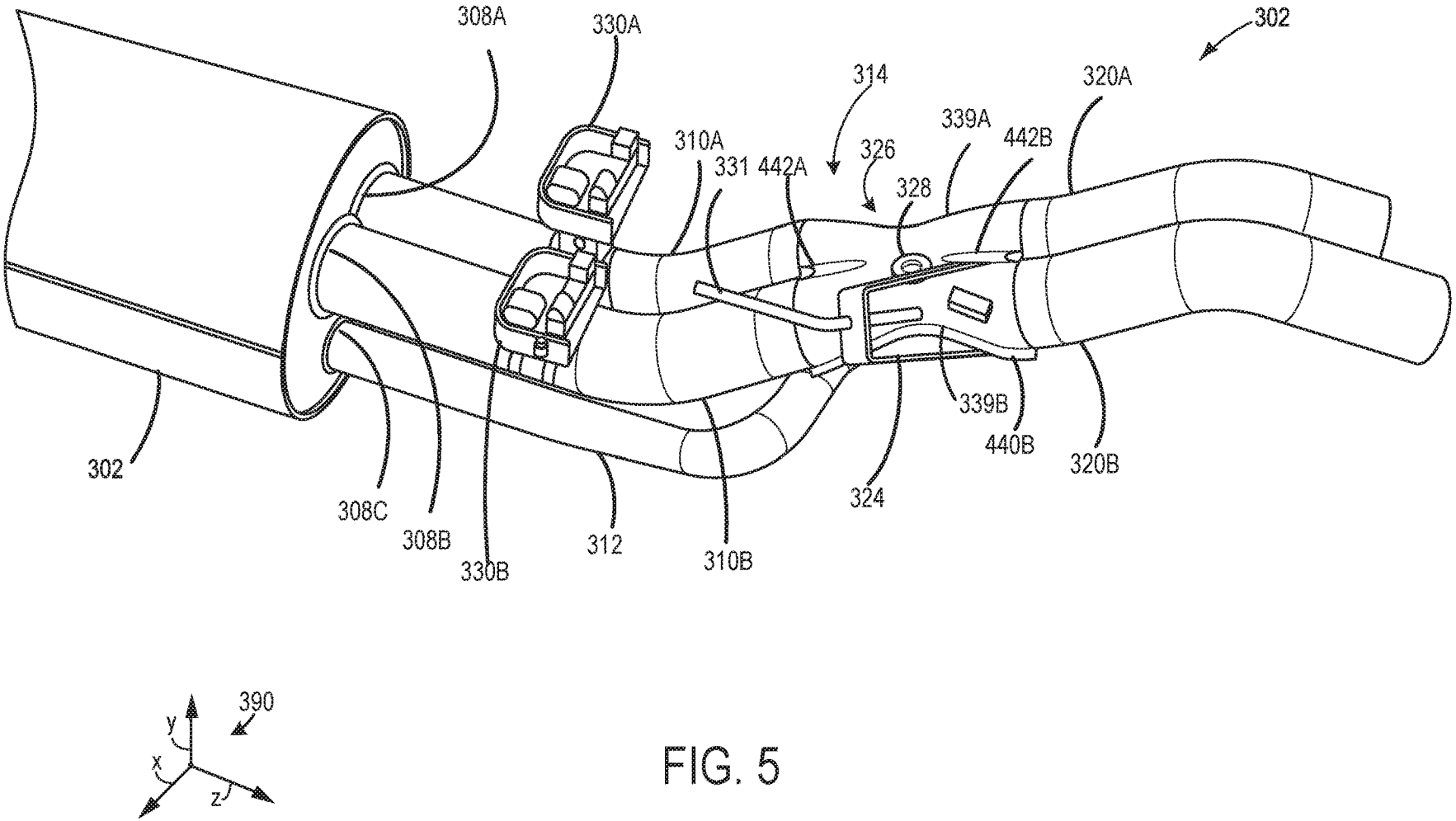
Figure 6:
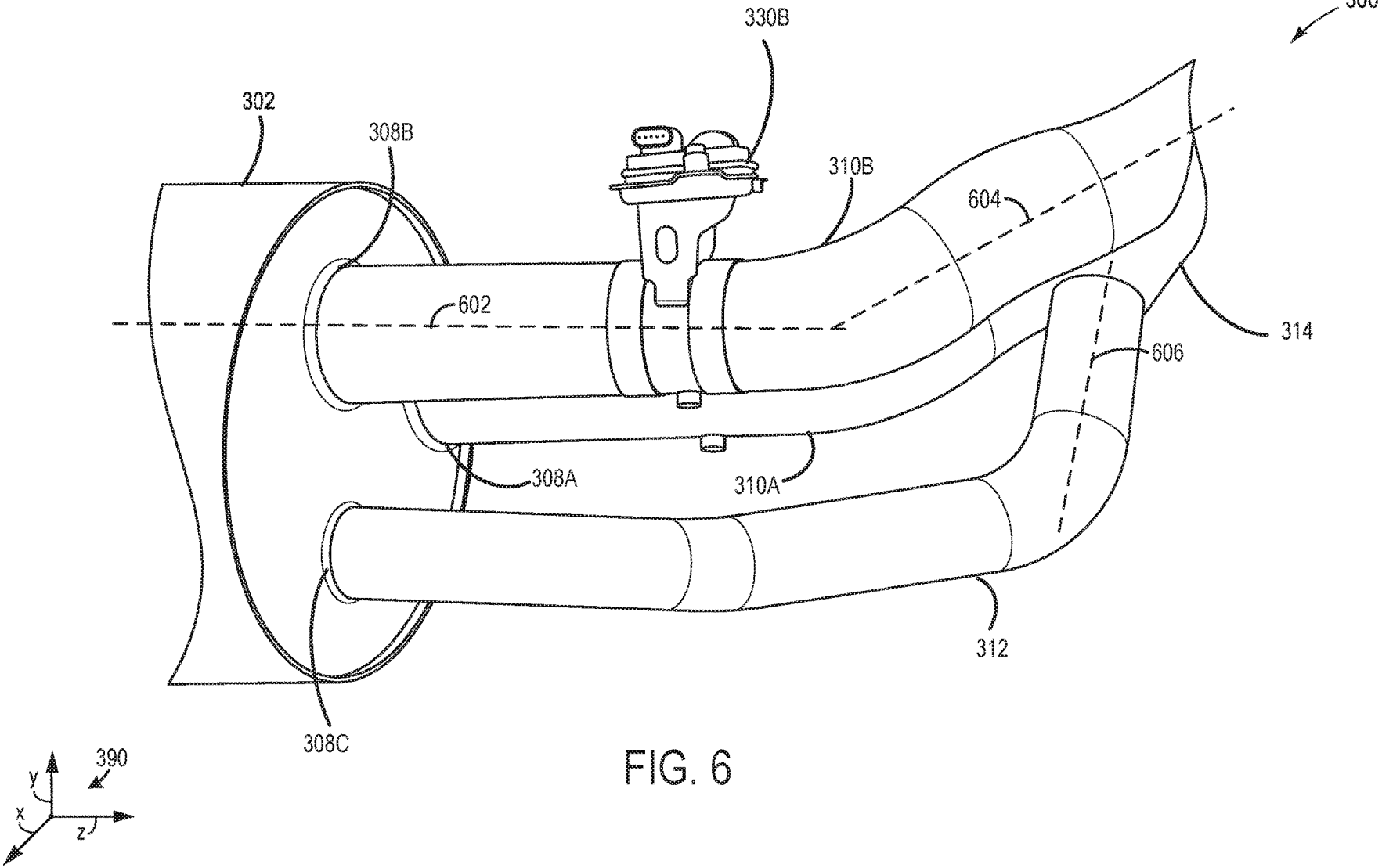
Figure 7:
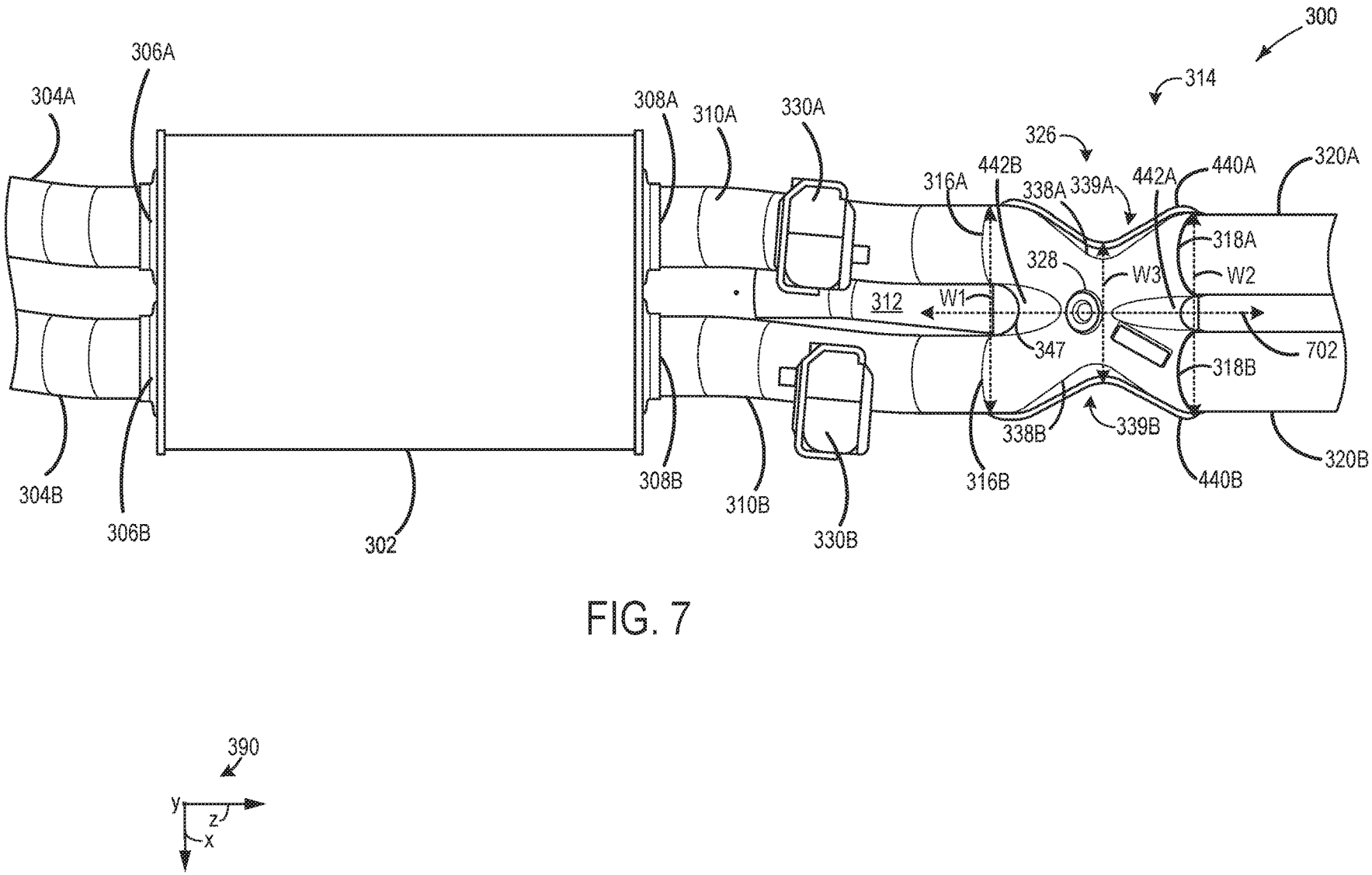
Figure 8:
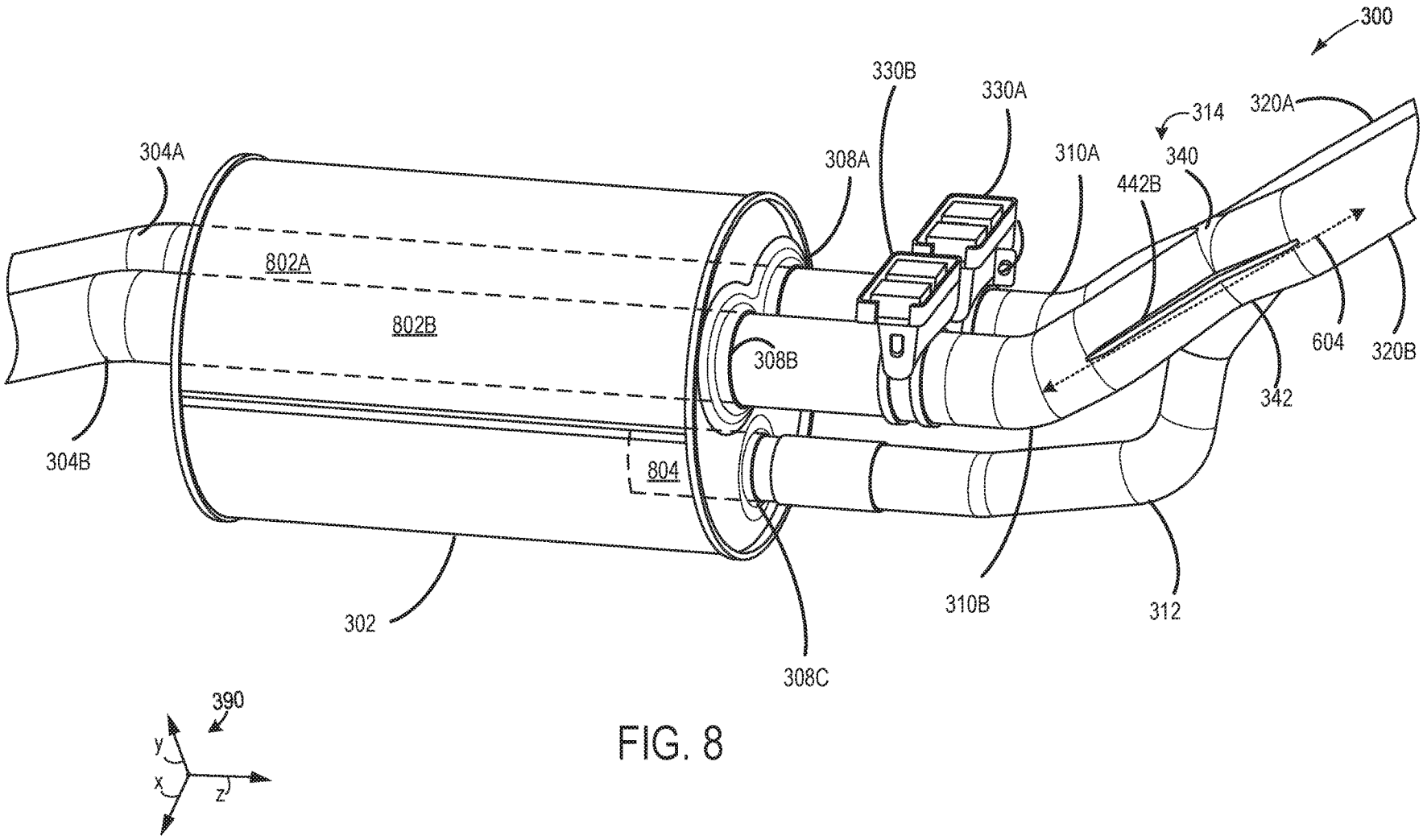
Figure 9:
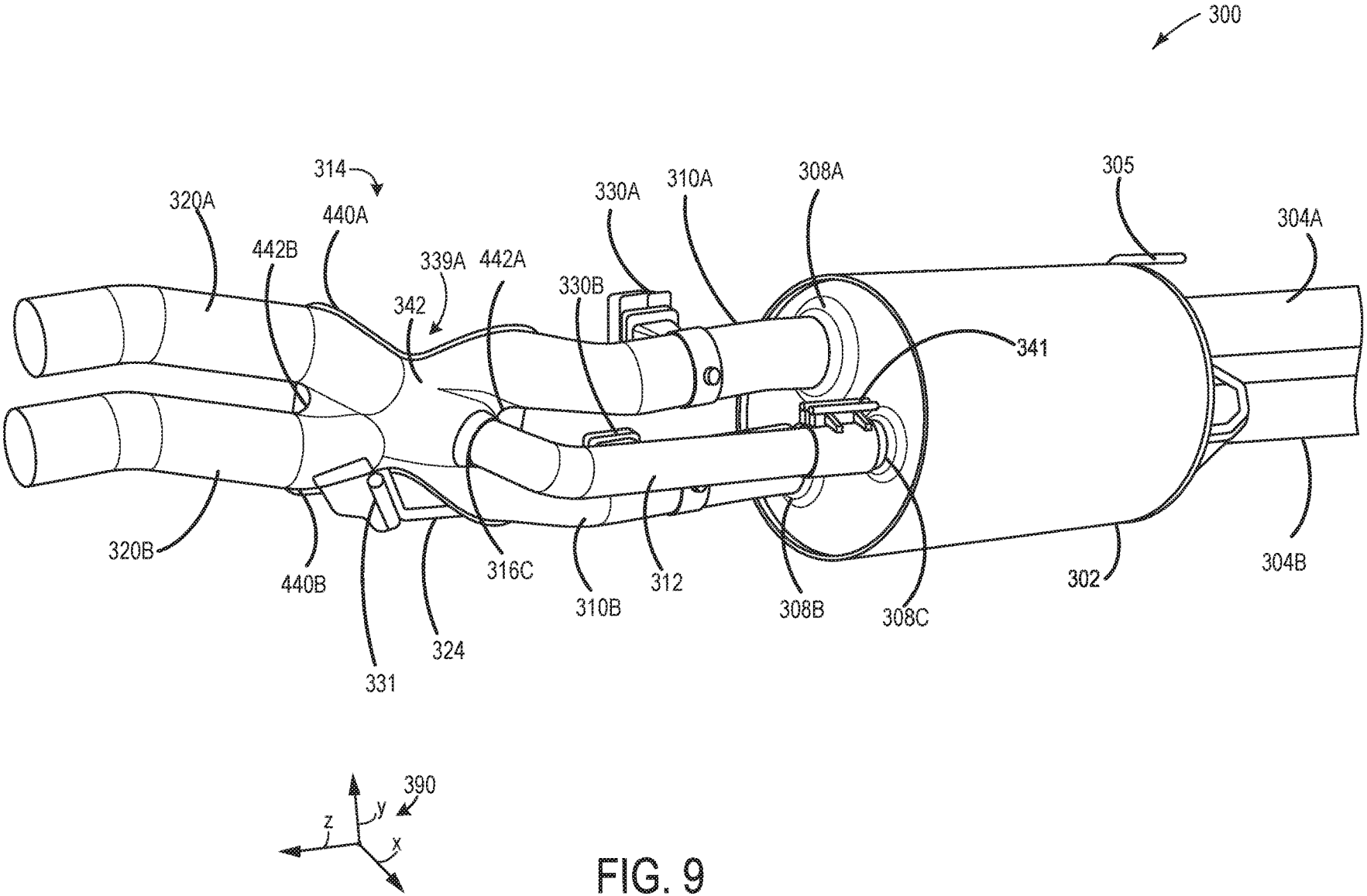
Figure 10:
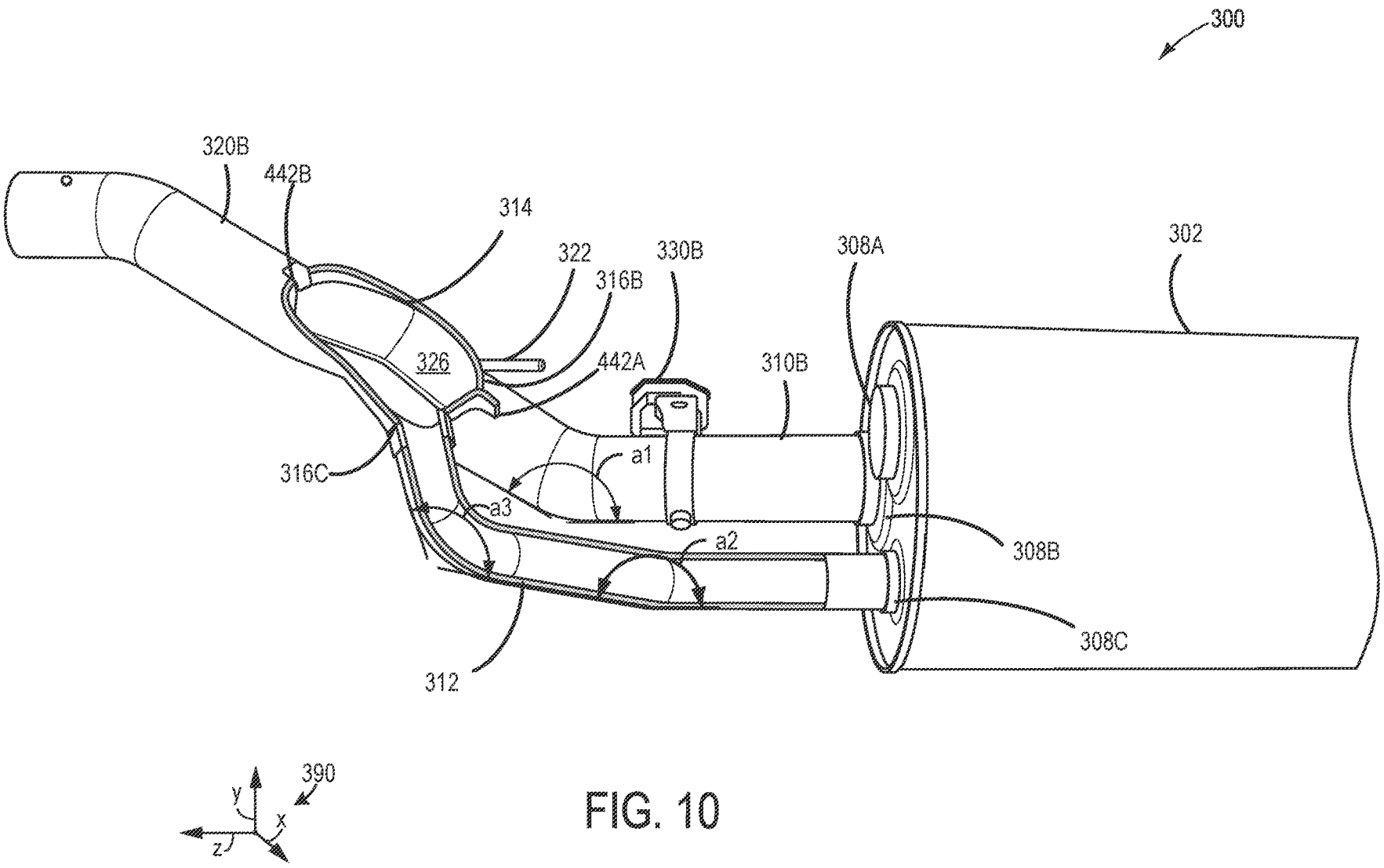
Figure 11:
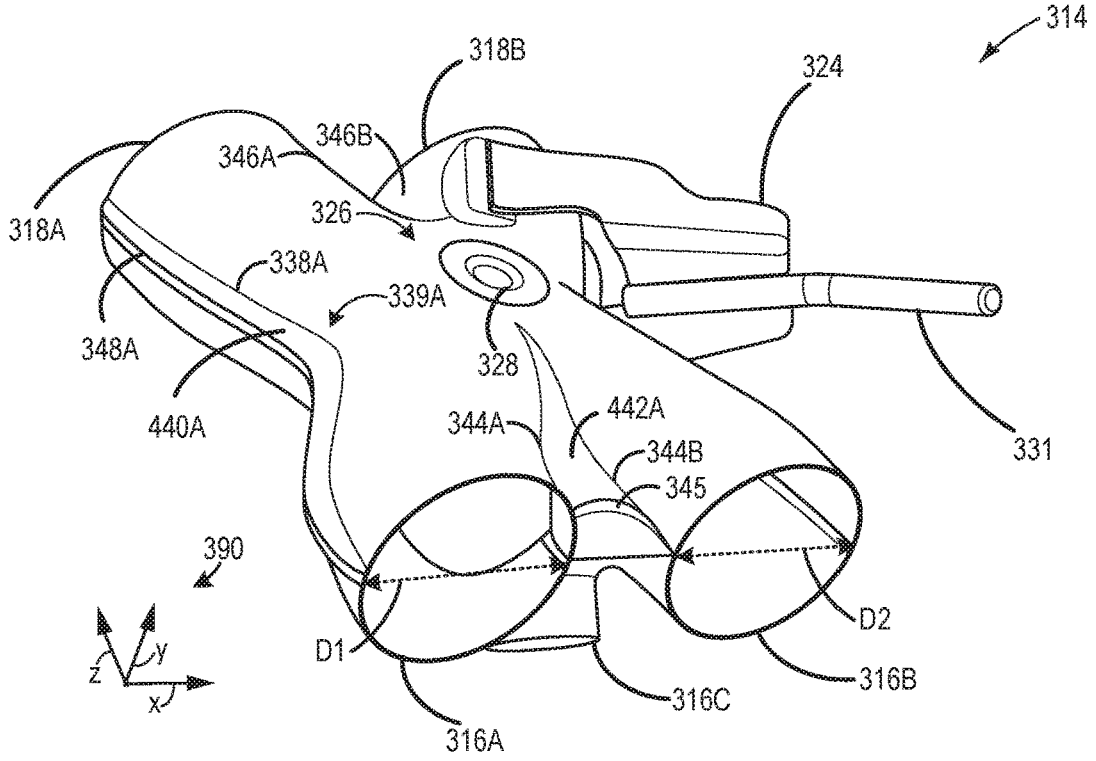
FIGS. 11 and 12 show the X-Y shaped intersection of the exhaust system of FIGS. 3-10.
Figure 12:
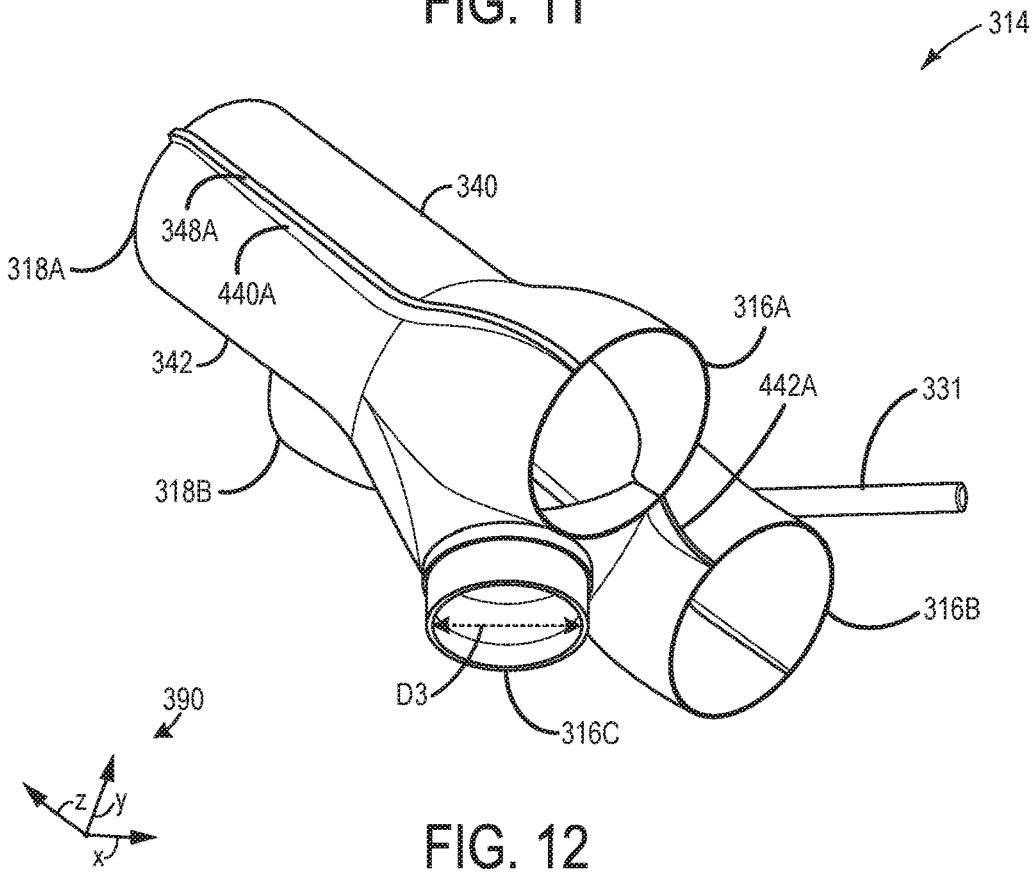

FIGS. 3-12 show an exhaust system 300 including a 2-in, 3-out muffler configuration as described above. The exhaust system 300 illustrated in FIGS. 3-12 is a non-limiting example of the exhaust system coupled to engine 10 described above with respect to FIG. 2. FIG. 3 is a perspective view of the exhaust system 300. FIGS. 4, 5, and 8 show magnified top perspective views of the exhaust system 300. FIG. 6 shows a magnified side view of the exhaust system 300. FIG. 7 shows a top magnified view of the exhaust system 300 6. FIG. 9 shows a magnified bottom perspective view of the exhaust system 300. FIG. 10 shows a magnified side view of the exhaust system 300, with a portion of the exhaust system cut away to show detail. FIGS. 11 and 12 show isolated magnified views of an X-Y-shaped intersection of the exhaust system 300. FIGS. 3-12 are described collectively. Each of FIGS. 3-12 includes a Cartesian coordinate system 390, where y is vertical with respect to gravity when the exhaust system is mounted in a vehicle positioned on flat ground.

The exhaust system 300 includes a first exhaust passage 304A and a second exhaust passage 304B fluidly coupled to a muffler 302 on an upstream/inlet side of the muffler 302. The first exhaust passage 304A may be fluidly coupled to the muffler 302 through a first muffler inlet 306A, shown in FIG. 7. The second exhaust passage 304B may be fluidly coupled to the muffler 302 through a second muffler inlet 306B, shown in FIG. 7. Exhaust gas from an engine (e.g., engine 10) may pass through the first exhaust passage 304A, through the first inlet 306A, and into the muffler 302. Exhaust gas from the engine may also pass through the second exhaust passage 304B, through the second inlet 306B into the muffler 302. While not shown in FIG. 3, the first exhaust passage 304A and the second exhaust passage 304B may be fluidly coupled upstream of the muffler 302 via an X-shaped intersection (e.g., an X-pipe), as shown and described above with respect to FIG. 2. In other examples, the first exhaust passage 304A and the second exhaust passage 304B may not fluidly couple to each other upstream of the muffler 302.

The muffler 302 may comprise various chambers and baffles which may interact with the exhaust gas to attenuate exhaust noise. Fluidly coupled to the first muffler inlet 306A may be a first internal pipe 802A, which is shown in dashed lines in FIG. 8 to indicate that the first internal pipe 802A is an internal structure that would not be visible in the view shown in FIG. 8. The first internal pipe 802A may comprise a hollow cylinder (or other suitable shape), such that exhaust may pass through the first internal pipe 802A. However, the outer circumferential surface of the first internal pipe 802A may have one or more holes through which exhaust may flow out into the body of the muffler, at least in some embodiments. In another embodiment, the first internal pipe 802A may be discontinuous, such that one or more gaps are present between the upstream and downstream portion of the first internal pipe 802A. A second internal pipe 802B, also shown in dashed lines in FIG. 8, may fluidly couple to the second muffler inlet 306B. This second internal pipe 802B may comprise a hollow cylinder (or other suitable shape), such that exhaust may pass through the second internal pipe 802B, and in some examples the outer circumferential surface of the second internal pipe 802B may have one or more holes through which exhaust may flow out into the body of the muffler. As another example, the second internal pipe 802B may be discontinuous, such that one or more gaps are present between the upstream and downstream portion of the second internal pipe 802B.

The muffler 302 may additionally comprise a first muffler outlet 308A, fluidly coupling the first internal pipe 802A to a first exhaust outlet pipe 310A. A second muffler outlet 308B, laterally adjacent to the first muffler outlet 308A, may fluidly couple the second internal pipe 802B to a second exhaust outlet pipe 310B. Exhaust gas may flow out of the muffler 302 and into the first exhaust outlet pipe 310A through the first muffler outlet 308A. Similarly, exhaust gas may flow out of the muffler 302 and into the second exhaust outlet pipe 310B through the second muffler outlet 308B. A third muffler outlet 308C may be fluidly coupled to a bypass duct 312. Exhaust may flow from the muffler 302 into the bypass duct 312 through the third muffler outlet 308C. As shown in FIG. 8, the muffler 302 may include a bypass pipe 804 fluidly coupling the internal body of the muffler 302 to the third muffler outlet 308C. The bypass pipe 804 may terminate in the body of the muffler 302 and may be a hollow cylinder (or other suitable shape) with an opening at the terminating end, to allow exhaust gas flowing in the muffler 302 to exit the muffler 302 via the third muffler outlet 308C, at least during some conditions.

As will be described in more detail below, the first exhaust outlet pipe 310A and the second exhaust outlet pipe 310B may fluidly couple to each other at an X-pipe (e.g., an X-shaped section of pipe). The bypass duct 312 may terminate at the X-pipe, thereby forming a combined X-Y shaped intersection 314 (e.g., where the X-pipe combines with a Y-pipe). The X-Y shaped intersection 314 may include three inlets (one coupled to the first exhaust outlet pipe 310A, one coupled to the second exhaust outlet pipe 310B, and one coupled to the bypass duct 312) and two outlets (a first outlet coupled to a first downstream exhaust pipe 320A and a second outlet coupled to a second downstream exhaust pipe 320B).

The first downstream exhaust pipe 320A may terminate at a first tailpipe (not shown) and the second downstream exhaust pipe 320B may terminate at a second tailpipe 322. The first downstream exhaust pipe 320A and the second downstream exhaust pipe 320B may include one or more bends or curves that may be present to position each tailpipe at a desired position on the vehicle (at the rear of the vehicle, with one tailpipe on a left side and the other tailpipe on the right side). For example, as shown, each downstream exhaust pipe may include a first bend after emerging from the X-Y shaped intersection 314. The first downstream exhaust pipe 320A may then include a second bend and a third bend. The second downstream exhaust pipe 320B may include, after the first bend, a second bend, a third bend, and a fourth bend. The different curvatures of the downstream exhaust pipes may influence exhaust gas flow and may impact exhaust noise characteristics.

As shown in more detail in FIGS. 4-6, the first exhaust outlet pipe 310A may comprise two straight portions and a curved portion. A first straight portion of the first exhaust outlet pipe 310A may extend from the first muffler outlet 308A. The first straight portion of the first exhaust outlet pipe 310A may extend along a first axis (shown in FIG. 6 as first axis 602), which may be substantially parallel to the z-axis of coordinate system 390 and may be parallel to a longitudinal axis of the muffler 302. The first exhaust outlet pipe 310A may comprise a first curved portion. The first curved portion may be curved at a first angle, such that the second straight portion, extending from the first curved portion, extends upward along the y axis. As shown in FIG. 10, the first angle (angle a1 in FIG. 10) may be 150°, although other angle measurements are considered (e.g., 130°, 140°, 160°). The first curved portion may terminate downstream at the second straight portion of the first exhaust outlet pipe 310A. The second straight portion may extend from the first curved portion along a second axis (shown in FIG. 6 as second axis 604) to fluidly couple to the X-Y-shaped intersection 314.

The second exhaust outlet pipe 310B may likewise comprise two straight portions and a curved portion. Thus, the second exhaust outlet pipe 310B may include a third straight portion that may extend from the second muffler outlet 308B. The third straight portion of the second exhaust outlet pipe 310B may extend along the first axis. The second exhaust outlet pipe 310B may comprise a second curved portion. The second curved portion may be curved at the first angle, similar to the first curved portion of the first exhaust outlet pipe 310A. The second curved portion may terminate downstream at a fourth straight portion. The fourth straight portion may extend along the second axis to fluidly couple to the X-Y-shaped intersection 314.

In FIG. 10, only the second exhaust outlet pipe 310B is shown and the first exhaust outlet pipe 310A is not shown for visual clarity and to allow underlying features that would otherwise be obscured to be viewed. Further, in FIG. 10, a portion of the bypass duct 312 and the X-Y shaped intersection are shown in cross-section. However, the first curved portion of the first exhaust outlet pipe 310A may have an angle substantially similar (e.g. identical) to the angle a1 of the second curved portion of the second exhaust outlet pipe. The angle at which the fourth straight portion extends from the second curved portion may be similar (e.g. identical) to the angle from which the second straight portion extends from the first curved portion.

The bypass duct 312 may comprise three straight portions and two curved portions. The three straight portions of the bypass duct 312 may include a fifth straight portion, a sixth straight portion, and a seventh straight portion, and the two curved portions of the bypass duct 312 may include a third curved portion and a fourth curved portion. The fifth straight portion may extend from the third muffler outlet 308C. The fifth straight portion may extend substantially parallel to the first exhaust outlet pipe 310A and to the second exhaust outlet pipe 310B. Thus the fifth straight portion may extend parallel to the first axis. The third curved portion may fluidly connect the fifth straight portion to the sixth straight portion. The third curved portion may extend from the downstream end of the fifth straight portion at an angle offset from parallel to the first axis. In the example shown in FIG. 10, the angle of the third curved portion (shown as angle a2 in FIG. 10) is 170°. However, other angles are possible without departing from the scope of this disclosure. The sixth straight portion may extend from the third curved portion and terminate at the fourth curved portion. The fourth curved portion may have a suitable angle such that the seventh straight portion, which fluidly couples to the X-Y shaped intersection 314, extends substantially perpendicular to the first axis. For example, as shown in FIGS. 6 and 10, the fourth curved portion may have an angle a3 that may be 120° or other suitable angle and the sixth straight portion may extend along a third axis 606.

The respective curves of the first exhaust outlet pipe 310A, the second exhaust outlet pipe 310B, and the bypass duct 312 may facilitate exhaust flow through the exhaust system. The angles of the curved portions may be substantially greater than 90°, allowing for easier flow through the pipes/duct, while allowing for the desired attenuation of sound.

The X-Y-shaped intersection 314 may comprise three inlets and two outlets, forming an X-shaped portion (where the first exhaust outlet pipe 310A and second exhaust outlet pipe 310B merge and then diverge to the first downstream exhaust pipe 320A and the second downstream exhaust pipe 320B) and a Y-shaped portion (where the bypass duct terminates at the X-shaped portion). A first intersection inlet 316A of the X-Y shaped intersection 314 may fluidly couple to the first exhaust outlet pipe 310A. A second intersection inlet 316B of the X-Y shaped intersection 314 may fluidly couple to the second exhaust outlet pipe 310B. A third intersection inlet 316C of the X-Y shaped intersection 314 may fluidly couple to the bypass duct 312, and thus may be referred to herein as a bypass duct inlet. The first intersection inlet 316A may be positioned vertically above the vertical position of the first muffler outlet 308A (e.g., along the y axis and with respect to a ground on which the vehicle sits). The second intersection inlet 316B may be positioned at a lateral distance from the first intersection inlet 316A and vertically above the second muffler outlet 308B. In the example shown in FIGS. 11-12, the second intersection inlet 316B may be positioned at the same vertical height as the first intersection inlet 316A. The third intersection inlet 316C may fluidly couple the bypass duct 312 to the X-Y-shaped intersection 314.

The X-Y-shaped intersection 314 may additionally comprise two outlets, placed downstream of the three inlets. A first intersection outlet 318A of the X-Y shaped intersection 314 may be placed longitudinally offset from and vertically above the first intersection inlet 316A. A second intersection outlet 318B of the X-Y shaped intersection 314 may be placed longitudinally offset from and vertically above the second intersection inlet 316B.

The first intersection outlet 318A may fluidly couple to the first downstream exhaust pipe 320A. Exhaust may flow from the first intersection outlet 318A through the first downstream exhaust pipe 320A. The first downstream exhaust pipe 320A may fluidly couple to the first tailpipe, where exhaust is vented to the atmosphere. The second intersection outlet 318B may fluidly couple to the second downstream exhaust pipe 320B. Exhaust may flow from the second intersection outlet 318B through the second downstream exhaust pipe 320B, exiting to atmosphere via the second tailpipe 322.

As shown in FIG. 7, the X-Y shaped intersection 314 may have a first overall width W1 at the inlet side of the X-Y shaped intersection 314, extending from an outer edge of the first intersection inlet 316A to an outer edge of the second intersection inlet 316B. The X-Y shaped intersection 314 may have a second overall width W2 at the outlet side of the X-Y shaped intersection 314, extending from an outer edge of the first intersection outlet 318A to an outer edge of the second intersection outlet 318B. In some examples, W1 may be equal to W2. At a central portion 326 of the X-Y shaped intersection 314, the X-Y shaped intersection 314 may have an inner width W3, which may be smaller than W1 and W2 and in some examples may be the narrowest width of the X-Y shaped intersection 314. In this way, the shape of the X-Y shaped intersection 314, from the top view shown in FIG. 7, may resemble the letter X. At the central portion 326 and across W3, the X-Y shaped intersection 314 may be open and unobstructed across the entirety of the interior of the X-Y shaped intersection 314. In contrast, at the inlet side and outlet side of the X-Y shaped intersection, the interior may be bifurcated into two passages that merge at the central portion 326. In some examples, the central portion 326 may be defined as the portion of the X-Y shaped intersection 314 where the two inlets merge into one open area and extending until the two outlets are formed. At the central portion 326, the third intersection inlet 316C merges with the open area of the central portion 326. The X-Y shaped intersection 314 includes a center point at the top surface, at which an indentation 328 is positioned. The indentation 328 may increase the stamping stiffness of the X-Y shaped intersection 314.

Thus, the X-Y shaped intersection 314 comprises a bifurcated inlet formed from the first intersection inlet 316A and the second intersection inlet 316B. Each of the first intersection inlet 316A and the second intersection inlet 316B are angled inward toward the central portion 326 of the X-Y shaped intersection (e.g., angled inward in the downstream direction). For example, as shown in FIG. 7, the X-Y shaped intersection 314 may have a central longitudinal axis 702, and the first intersection inlet 316A may angle toward the central longitudinal axis 702 at a first angle (e.g., 25°) Likewise, the second intersection inlet 316B may angle toward the central longitudinal axis 702 at a second angle (e.g., −25°). As explained above, the first intersection inlet 316A and the second intersection inlet 316B merge at the central portion 326, upstream of the indentation 328.

Similarly, the X-Y shaped intersection 314 comprises a bifurcated outlet formed from the first intersection outlet 318A and the second intersection outlet 318B. Each of the first intersection outlet 318A and the second intersection outlet 318B are angled outward from the central portion 326 of the X-Y shaped intersection to the terminating edges of the outlets. For example, the first intersection outlet 318A may angle away from the central longitudinal axis 702 at a first angle (e.g., 25°). Likewise, the second intersection outlet 318B may angle away from the central longitudinal axis 702 at a second angle (e.g., −25°). As explained above, the first intersection outlet 318A and the second intersection outlet 318B diverge in the downstream direction, starting at the central portion 326, downstream of the indentation 328.

Thus, the X-Y shaped intersection 314 may have a first lateral outer surface 338A that may include a first concave curve 339A. The first X-Y shaped intersection 314 may also include a second lateral outer surface 338B including a second concave curve 339B. The diameter W3 may span the distance from a first midpoint (e.g., the innermost portion) of the first concave curve 339A to a second midpoint (e.g., the innermost portion) of the second concave curve 339B.

The X-Y shaped intersection 314 further includes a first lateral rib 440A positioned on the first lateral outer surface 338A, at a midpoint between a top surface 340 of the X-Y shaped intersection 314 (shown in FIG. 12) and a bottom surface 342 of the X-Y shaped intersection (also shown in FIG. 12). The first lateral rib 440A may extend along an axis 332, lateral and parallel to the axis 604, although other positions are considered. The first lateral rib 440A may comprise a flat upper surface and a flat lower surface, both extending parallel to the axis 604. The first lateral rib 440A may extend laterally outwards from the first lateral outer surface 338A and may follow the curve of the first concave curve 339A (e.g., a first outward-facing surface 348A of the first lateral rib 440A may also be a concave curve).

The first lateral rib 440A may have a height across the first outward-facing surface 348A of the first lateral rib 440A measuring from the surface of the first upper face to the surface of the first lower face, and the height of the first lateral rib 440A may be within a threshold range of a height of the first and second longitudinal ribs (e.g., within 5-10%).

The X-Y shaped intersection 314 further includes a second lateral rib 440B, on the second lateral outer surface 338B, opposite the first lateral rib 440A, and also positioned at a midpoint between the top surface 340 and the bottom surface 342, along the axis 332. The second lateral rib 440B may, similarly to the first rib, strengthen the X-Y shaped intersection, as well as minimize distortion.

The second lateral rib 440B may extend laterally and parallel to the axis 604, although other positions are considered. The second lateral rib 440B may comprise a flat upper surface and a flat lower surface, both extending parallel to the axis 604. The second lateral rib 440B may extend laterally outwards from the second lateral outer surface 338B and may follow the curve of the second concave curve 339B.

The second lateral rib 440B may have a height across an second outward-facing surface 348B of the second lateral rib 440B measuring from the surface of the first upper face to the surface of the first lower face, and the height of the second lateral rib 440B may be within a threshold range of a height of the first and second longitudinal ribs (e.g., within 5-10%).

In some embodiments, the first lateral rib 440A may extend from the most upstream portion of the first intersection inlet 316A to the most downstream portion of the first intersection outlet 318A. In other embodiments, the first lateral rib 440A may extend a longitudinal distance downstream of the most upstream portion of the first intersection inlet 316A, and a longitudinal distance upstream of the most downstream portion of the first intersection outlet 318A.

Similarly, in some embodiments, the second lateral rib 440B may extend from the most upstream portion of the second intersection inlet 316B to the most downstream portion of the second intersection outlet 318B. In other embodiments, the second lateral rib 440B may extend a longitudinal distance downstream of the most upstream portion of the second intersection inlet 316B, and a longitudinal distance upstream of the most downstream portion of the second intersection outlet 318B.

The first lateral rib 440A and the second lateral rib 440B may provide support and rigidity in order to minimize vibration and distortion of the X-Y shaped intersection.

The X-Y shaped intersection 314 may further include a first inner rib 442A positioned in a space between the first intersection inlet 316A and the second intersection inlet 316B (vertically above the third intersection inlet 316C). The first inner rib 442A may extend from a third lateral outer surface 344A of the first intersection inlet 316A (opposite the first lateral outer surface 338A) to a fourth lateral outer surface 344B (opposite the second lateral outer surface 338B) of the second intersection inlet 316B. The first inner rib 442A may comprise a flat, first face extending along a first plane, and a flat, second face, extending along a second plane, parallel to the first plane. The first face and the second face may extend laterally outward and approximately parallel to axis 604, although other angles and positions are considered. The first inner rib 442A may have a height across an outward-facing surface 345 of the rib 442A measuring from the surface of the first face to the surface of the second face, and the height of the first inner rib 442A may be within a threshold range of a height of the first and second lateral ribs (e.g., within 5-10%). The first inner rib 442A may extend from the terminating edge of the first intersection inlet 316A to where the third and fourth lateral outer surfaces merge, and may also extend from the terminating edge of the second intersection inlet 316B to where the third and fourth lateral outer surfaces merge. The outward-facing surface 345 of first inner rib 442A may be curved inward with a radius of curvature selected to provide desired vibrational reduction.

The first inner rib 442A may strengthen and support the X-Y shaped intersection and maintain the lateral distance between the first exhaust outlet pipe 310A and the second exhaust outlet pipe 310B, which may help reduce vibration, at least in some examples.

The X-Y shaped intersection 314 includes a second inner rib 442B between the first intersection outlet 318A and the second intersection outlet 318B. The second inner rib 442B may extend from a fifth lateral outer surface 346A of the first intersection outlet 318A to a sixth lateral outer surface 346B of the second intersection outlet 318B. The second inner rib 442B (and the first inner rib 442A) may be positioned at a midpoint between the top surface 340 and the bottom surface 342 of the X-Y shaped intersection 314. The third intersection inlet 316C (coupled to the bypass duct 312) may be directly under the first inner rib 442A. The second inner rib 442B may comprise a flat, first face extending along a third plane, and a flat, second face, extending along a fourth plane, parallel to the third plane. The second inner rib 442B may have a height across an outward-facing surface 347 of the second rib 442B that is equal to the height of the first inner rib 442A. The second inner rib 442B may extend from the terminating edge of the first intersection outlet 318A to where the fifth and sixth lateral outer surfaces merge, and may also extend from the terminating edge of the second intersection outlet 318B to where the fifth and sixth lateral outer surfaces merge. The outward-facing surface 347 of second inner rib 442B may be curved inward with a radius of curvature selected to provide desired vibrational reduction.

The second inner rib 442B may strengthen and support the X-Y shaped intersection 314 and maintain the lateral distance between the first downstream exhaust pipe and the second downstream exhaust pipe, and may reduce vibrations, at least in some examples.

As shown in FIG. 7, the X-Y shaped intersection may be bilaterally symmetrical about a yz plane at the central longitudinal axis 702. The axis 702 may divide the X-Y shaped intersection 314 into two lateral halves, each having approximately equal proportions. As the bypass duct 312 and the third intersection inlet 316C may extend from the lower portion of the X-Y-shaped intersection and not from the upper portion, the X-Y shaped intersection may not be symmetrical about the z axis. For example, if the X-Y shaped intersection were cut across an xz plane at the midpoint between the top and bottom surfaces (e.g., across the lateral ribs described above), the X-Y shaped intersection 314 would not be symmetric across this plane. Further, the X-Y shaped intersection is not symmetric across an xy plane at an axis aligned with the width W3 shown in FIG. 7. However, the X-shaped portion of the X-Y shaped intersection (excluding the third intersection inlet 316C) may be approximately symmetric across both the xz plane and the xy plane described above.

As shown in FIG. 11, the first intersection inlet 316A may have a first diameter D1, resulting in the first intersection inlet 316A having a first cross-sectional area. The second intersection inlet 316B may have a second diameter D2, resulting in the second intersection inlet 316B having a second cross-sectional area. In some examples, D1 may be equal to D2 and the first cross-sectional area may be equal to the second cross-sectional area, though other configurations are possible (e.g., one inlet being larger than the other). In some examples, D1 and D2 may each be smaller than W3. Further, a third cross-sectional area of the central portion 326 (e.g., at W3) may be larger than each of the first cross-section area and the second cross-section area but may be smaller than a combined cross-sectional area of the first intersection inlet 316A and the second intersection inlet 316B. While not illustrated, in some examples, the first intersection outlet 318A may have the same diameter as the first intersection inlet 316A and the second intersection outlet 318B may have the same diameter as the second intersection inlet 316B.

As shown in FIG. 12, the third intersection inlet 316C may have a third diameter D3, which may result in the third intersection inlet 316C having a third cross-sectional area. In the example illustrated herein, D3 is smaller than D1 and D2, and the third cross-sectional area is smaller than each of the first and second cross-sectional areas.

In this way, exhaust gas may flow from the first exhaust outlet pipe 310A, the second exhaust outlet pipe 310B, and/or the bypass duct 312, into the X-Y-shaped intersection 314. Exhaust gas from the outlet pipes and the bypass duct may mix in the central portion 326 of the X-Y-shaped intersection 314, such that exhaust gas from the outlet pipes and the bypass duct may flow into both the first downstream exhaust pipe 320A and the second downstream exhaust pipe 320B. For example, exhaust flowing from the first exhaust outlet pipe 310A may flow through both the first downstream exhaust pipe 320A and the second downstream exhaust pipe 320B. During conditions in which more exhaust is flowing through one outlet pipe than another, this mixing may evenly distribute the flow of exhaust gas through the first downstream exhaust pipe 320A and the second downstream exhaust pipe 320B. This may reduce exhaust back pressure, improving engine power output. The X-shape portion of the X-Y shaped intersection 314 may change the exhaust sound characteristics relative to exhaust system configurations where the outlet pipes are maintained separate, such that exhaust flowing through two separate outlet pipes may sound different than exhaust flowing through the X-Y shaped intersection, leading to desirable sound characteristics.

A pair of valve actuators may be in communication with a pair of active exhaust valves controllable to adjust the exhaust system 300 to a louder or quieter operation mode. The first exhaust outlet pipe 310A may be coupled to a first valve actuator 330A situated downstream of the muffler 302, but upstream of the first curved portion of the first exhaust outlet pipe 310A. The first valve actuator 330A may be coupled to a first active exhaust valve located internally to the first exhaust outlet pipe 310A (such as the first active exhaust valve 75A described above with respect to FIG. 2). The first valve actuator 330A may adjust a position of the first active exhaust valve responsive to a command from a controller (such as controller 12 shown in FIGS. 1-2). The first active exhaust valve may be adjusted between fully open and fully closed, and in some examples may be adjusted to one or more positions between fully open and fully closed. When fully closed, the first active exhaust valve may block exhaust gas from flowing through the first exhaust outlet pipe 310A. The first active exhaust valve (e.g., the first valve actuator 330A) may be mounted vertically with respect to the first exhaust outlet pipe 310A. For example, the first valve actuator 330A may extend upward from the first exhaust outlet pipe 310A parallel to the y axis. The vertical mounting of the first active exhaust valve may assist in reducing vibrations and/or protect the active exhaust valve from stone pecking.

The second exhaust outlet pipe 310B may be coupled to a second valve actuator 330B situated downstream of the muffler 302, but upstream of the second curved portion of the second exhaust outlet pipe 310B. The second valve actuator 330B may adjust a position of the second active exhaust valve responsive to a command from the controller. The second active exhaust valve may be adjusted between fully open and fully closed, and in some examples may be adjusted to one or more positions between fully open and fully closed. When fully closed, the second active exhaust valve may block exhaust gas from flowing through the second exhaust outlet pipe 310B. The second active exhaust valve (e.g., the second valve actuator 330B) may be mounted vertically with respect to the second exhaust outlet pipe 310B. For example, the second valve actuator 330B may extend upward from the second exhaust outlet pipe 310B parallel to the y axis. The vertical mounting of the second active exhaust valve may assist in reducing vibrations and/or protect the active exhaust valve from stone pecking.

The bypass duct 312 may flow a smaller volume of exhaust gas, as compared to the volume of the exhaust gas flowing through the first exhaust outlet pipe 310A and second exhaust outlet pipe 310B when their respective active exhaust valves are at their most open position. The bypass duct 312 may not have any obstructions or valves which impede or stop exhaust flow. In other words, exhaust gas flowing through the bypass duct may flow in an unimpeded manner, although the volume and/or rate of exhaust flow through the bypass duct may vary based on the state of the first active exhaust valve and the second active exhaust valve.

The exhaust system may operate in several modes. The modes may be changed in response to operator input or control input based on the desired noise level of the operator and in response to engine use. In a first mode, both the first active exhaust valve and the second active exhaust valve are fully open (e.g. letting the most possible exhaust through the valve and into the downstream portion of the first exhaust outlet pipe 310A and the second exhaust outlet pipe 310B), exhaust gas exiting the muffler 302 may primarily flow into the first exhaust outlet pipe 310A and the second exhaust outlet pipe 310B and may not flow through the bypass duct 312 (though a small portion of the exhaust gas may flow through the bypass duct 312 even when both active exhaust valves are fully open). From the first exhaust outlet pipe 310A and second exhaust outlet pipe 310B, exhaust may flow into the X-Y-shaped intersection 314 and subsequently into the first downstream exhaust pipe 320A and the second downstream exhaust pipe 320B.

As mentioned previously, the first exhaust outlet pipe 310A and the second exhaust outlet pipe 310B may have inner diameters substantially larger than the inner diameter of the bypass duct 312. The restriction placed on the exhaust gas flow when the exhaust gas flows through the bypass duct 312 (e.g., relative to the flow through the outlet pipes) may result in changed exhaust noise characteristics, e.g., the exhaust noise may be lowered (decreased in volume). Thus, when operating in the first mode, the noise produced by the exhaust flowing through the larger first exhaust outlet pipe 310A and second exhaust outlet pipe 310B may be greater (e.g. louder in volume, deeper in pitch) than the noise produced by the exhaust flowing through the bypass duct 312 alone. The noise produced by the exhaust in this configuration may be desirable by an operator, in some circumstances.

In a second operation mode of the exhaust system 300, both the first active exhaust valve and the second active exhaust valve may be closed (e.g. allowing no exhaust to flow through the outlet pipes). If both active exhaust valves are closed, exhaust may primarily exit the muffler 302 through the bypass duct 312. The exhaust flowing through the bypass duct 312 may flow into the X-Y-shaped intersection 314. A percentage (e.g. 50%) of the exhaust may flow through the first downstream exhaust pipe 320A to be vented out of the first tailpipe, while the remaining percentage (e.g. 50%) of the exhaust may flow through the second downstream exhaust pipe 320B, and to be vented out of the second tailpipe.

When both active exhaust valves are closed, exhaust flows primarily through the bypass duct 312. From the bypass duct 312, the exhaust may flow through the third intersection inlet 316C into the X-Y-shaped intersection 314. In the second operation mode, the exhaust travels through the bypass duct with a restricted diameter for a portion of its path through the exhaust system. The smaller diameter D3 of the duct may restrict the exhaust as it flows through the exhaust system, dampening the noise of the exhaust. Further, when the active exhaust valves are closed, exhaust gas may not travel solely through the first and second internal pipes of the muffler but may instead be forced out of the first and second internal pipes via the holes or gaps described above, thereby forcing the exhaust gas to travel through the chambers and/or baffles of the muffler before entering the bypass pipe and exiting the muffler via the third outlet. The exhaust may exit the X-Y-shaped intersection via the first downstream exhaust pipe 320A and via the second downstream exhaust pipe 320B. Passing through the larger diameter first downstream exhaust pipe and second downstream exhaust pipe may maintain sound attenuation at a desired level, and may allow for decreased backpressure and more engine power when compared to an exhaust system in which the exhaust flow was relatively restricted through the entire path through the exhaust system.

In a third operation mode, one active exhaust valve may be open and one active exhaust valve may be closed, or both active exhaust valves may be partially closed. In the third mode, exhaust from the open active exhaust valve(s) may flow into the X-Y-shaped intersection 314 through the exhaust outlet pipe(s) to which the open active exhaust valve(s) is coupled. For example, if the first active exhaust valve is open and the second active exhaust valve is closed, then exhaust may pass the first active exhaust valve and flow through the first exhaust outlet pipe 310A into the X-Y-shaped intersection 314. The closed second active exhaust valve may prevent exhaust from flowing through the second exhaust outlet pipes 310B. In other examples, both active exhaust valves may be partially closed, resulting in a lowered flow of exhaust gas through each outlet pipe and an increased flow of exhaust gas through the bypass duct, relative to the active exhaust valves being fully open. In the third mode, exhaust noise may be attenuated relative to exhaust noise in the first mode but may be louder than exhaust noise while in the second mode.

In the third mode, after exhaust has traveled to the X-Y-shaped intersection 314, exhaust may flow out of the X-Y-shaped intersection 314, and into the first downstream exhaust pipe 320A and the second downstream exhaust pipe 320B. Exhaust may travel through the first downstream exhaust pipe to be expelled by the first tailpipe, while exhaust may travel through the second downstream exhaust pipe to be expelled by the second tailpipe.

Thus, the position of the active exhaust valves may be adjusted to produce desired exhaust noise characteristics. For example, an operator may enter a request (e.g., via an input button on a dashboard, touch screen interface, etc.) to operate the exhaust system in a quiet mode, and in response, the controller may send a command to fully close both active exhaust valves. With the active exhaust valves fully closed, all exhaust gas exiting the muffler may travel through the bypass duct, which may pose a restriction on the flow of exhaust gas that increases the residence time of the exhaust gas in the muffler and lowers exhaust noise. If the operator enters a request to operate the exhaust system in a loud/loaded mode (which in some examples may also be commanded by the controller based on operating conditions, e.g., high load), the controller may send a command to fully open both active exhaust valves. With the active exhaust valves fully open, the exhaust gas exiting the muffler may travel through both exhaust outlet pipes, and in some examples also through the bypass duct, which may cause an increase in exhaust noise. The exhaust noise level is controlled by the muffler internals and if the active exhaust valves are closed, the exhaust gas flow follows a specific route through the muffler internals where the sound will be tuned for the quiet mode, and this particular muffler internal route generates enough flow restriction that the bypass duct diameter can handle the exhaust gas flow. Regarding the loaded mode when the active exhaust gas valves are open, the muffler internal route is shorter with a specific tuning for the loaded mode.

The inclusion of the single bypass duct terminating at an intersection between the exhaust outlet pipes may change exhaust flow characteristics relative to exhaust systems where the muffler is coupled to two Y-pipes (e.g., two outlet pipes each having a separate bypass duct). As such, in order to achieve desired exhaust noise characteristics while the active exhaust valves are open and while the active exhaust valves are closed, the muffler 302 may be tuned based on the exhaust gas flow characteristics of the single bypass duct 312 and X-Y shaped intersection 314. This tuning may include addition or removal of baffles and/or chambers in the muffler, changes in flow paths of the exhaust gas through the muffler, changes in baffle or chamber characteristics, and so forth. This tuning of the muffler may result in a lighter muffler, which may increase fuel economy. Further, the X-Y shaped intersection may have a smaller packaging space than two separate Y-pipes and a separate X-pipe downstream of the two Y-pipes. The additional available packaging space may allow for a separate tuning device (e.g., resonator) to be positioned in front of the muffler.

In some examples, the X-Y shaped intersection 314 may be formed as a separate component that is then coupled (e.g., welded) to the first exhaust outlet pipe 310A, the second exhaust outlet pipe 310B, the bypass duct 312, the first downstream exhaust pipe 320A, and the second downstream exhaust pipe 320B. In some examples, the X-Y shaped intersection 314 may be formed by stamping or another suitable technique, such as casting. By stamping the X-Y shaped intersection 314 rather than forming two separate Y-pipes, manufacturing costs may be lowered and component weight may be reduced.

Various hanging points may be positioned throughout the exhaust system to provide surfaces for attaching the exhaust system to the chassis of the vehicle. The hanging points may be structures extending outward from the pipes, intersections, muffler, and/or actuators, and may each comprise a portion that may be parallel to the x or y-axes, to provide support for the weight of the exhaust system. The following positions are described as examples, and other positions and numbers of hanging points may be used. A first hanging point 305 may extend from the upstream end of the muffler 302. The first hanging point 305 may extend parallel to the longitudinal axis of the muffler 302, e.g., along the z axis. In some examples, as shown in FIG. 3, the first hanging point 305 may be coupled to a damper 307, which may include springs or other elements to absorb relative movement between the muffler and the vehicle chassis, thereby lowering vibrations. The X-Y shaped intersection may have a second hanging point 331. The second hanging point 331 may be coupled to the X-Y shaped intersection 314 via a bracket 324, which may be provided to reduce vibration of the exhaust system, allow secure connection of the second hanging point 331 to the X-Y shaped intersection 314, and/or provide other benefits. The bracket 324 may be coupled to both the top surface 340 and the bottom surface 342 of the X-Y shaped intersection and may extend outward from the X-Y shaped intersection 314 at an angle toward the muffler 302. The bracket 324 may include a bore through which the second hanging point 331 extends. Thus the bracket 324 may surround at least a portion of the second hanging point 331, in one example. The second hanging point 331 may include a rod that extends along the z axis, e.g., parallel to the longitudinal axis of the muffler. It should be appreciated that the second hanging point 331 and bracket 324 are removed from some views herein (e.g., FIG. 7) for clarity.

The first downstream exhaust pipe 320A may have a third hanging point 321, while a fourth hanging point 325 may be positioned on the second downstream exhaust pipe 320B. A fifth hanging point 327 may be positioned on the second tailpipe 322. There may be more or fewer hanging points at other placements on the exhaust system, as desired. For example, while not illustrated, a hanging point may be positioned on the first tailpipe as well.

Thus, the hanging points described herein (also referred to as hangers) may each include rods or other structures that extend horizontally (e.g., along the z axis) at a distance (e.g., 10-50 mm) away from the structure to which they are coupled (e.g., the exhaust pipes, X-Y shaped intersection, etc.). The horizontal rods may be coupled to a corresponding structure on the vehicle chassis or other part of the vehicle (e.g., vehicle floor). The locations on the exhaust system where the hanging points are positioned may be selected based on the shape of the exhaust system relative to the vehicle frame, desired vibrational characteristics, and other characteristics. This may include positioning a hanging point on the X-Y shaped intersection 314, as shown and described herein. By positioning a hanging point at the X-Y shaped intersection 314, structural integrity of the intersection may be maintained while reducing vibrations. However, in other examples, the hanging point on the intersection may dispensed with, and only hanging points positioned away from the intersection may be used. Further, in some examples, coupling bands may be used to secure various components herein. For example, each of the active exhaust valve actuators may be secured to a respective exhaust outlet pipe via a coupling band. Coupling bands may likewise be present to secure the various pipes to the muffler, secure joints where different pipes coupled together, etc. In some examples, the coupling bands may also include hanging points, such as the coupling band 341 shown in FIG. 9.

Thus, an exhaust system as described herein includes a 2-in, 3-out muffler with two main exhaust outlet pipes and a bypass duct each coupled to a respective muffler outlet. The muffler described herein (e.g., muffler 302) only includes three outlets and does not include any additional outlets other than the two outlets leading to the exhaust outlet pipes and the bypass outlet leading to the bypass duct. The exhaust outlet pipes and bypass duct may merge at an X-Y shaped intersection positioned downstream of the muffler by a suitable distance (e.g., a distance approximately equal to the length of the muffler, at least in some examples). The outlet pipes and the bypass duct may extend, at least initially, along respective axes that are each parallel to a longitudinal axis of the muffler (e.g., a horizontal axis parallel to flat ground when the vehicle is positioned on the flat ground). The X-Y shaped intersection may, in contrast, extend at an angle to each of these horizontal axes. As shown in FIGS. 6 and 8, the X-Y shaped intersection 314 may extend along an axis (axis 604) that is angled approximately 25-30° relative to the axis (e.g., axis 602) of the first and/or second exhaust outlet pipe. The angling of the X-Y shaped intersection may allow for the coupling of the bypass duct at a bottom of the X-Y shaped intersection in a manner that promotes suitable exhaust gas flow through the bypass duct and X-Y shaped intersection. As shown in FIG., the bypass duct 312 may extend along a third axis 606 when the bypass duct couples to the X-Y shaped intersection 314. The third axis may be angled substantially perpendicular (e.g., 75-90°) to the horizontal axis/first axis 602. The curvature of the bypass duct along with the upward angling of the X-Y shaped intersection may promote a desired flow of exhaust gas through the bypass duct, reducing exhaust backpressure and providing desirable noise characteristics.

The X-Y shaped intersection may include webbing/ribs that extent in parallel with the second/angled axis (e.g., second axis 604) of the X-Y shaped intersection. As explained above, each lateral side of the X-Y shaped intersection may include a lateral rib and the respective spaces between the inlets of the bifurcated inlet and the outlets of the bifurcated outlet may include an inner rib. The ribs may increase structural stability and reduce vibrations of the X-Y shaped intersection. Further, because of the relative short length of the bypass inlet and/or angling of the bypass inlet (e.g., the third intersection inlet 316C described herein), additional ribs/webbing is not included around the bypass inlet, at least in some examples.

Embodiments are provided for an exhaust system including a muffler; a first exhaust outlet pipe fluidly coupled to a first outlet of the muffler; a second exhaust outlet pipe fluidly coupled to a second outlet of the muffler; a bypass duct fluidly coupled to a third outlet of the muffler; and a combined X-Y shaped intersection at which the first exhaust outlet pipe, the second exhaust outlet pipe, and the bypass duct are fluidly coupled to each other. In a first example of the exhaust system, the first exhaust outlet pipe and the second exhaust outlet pipe each have a first cross-sectional area that is larger than a second cross-sectional area of the bypass duct. In a second example of the exhaust system, optionally including the first example, the first exhaust outlet pipe includes a first active exhaust valve coupled between the muffler and the combined X-Y shaped intersection and the second exhaust outlet pipe includes a second active exhaust valve coupled between the muffler and the combined X-Y shaped intersection. In a third example of the exhaust system, optionally including one or both of the first and second examples, the bypass duct is free of any valves or restrictions. In a fourth example of the exhaust system, optionally including one or more or each of the first through third examples, the combined X-Y shaped intersection includes an X-shaped portion comprising a bifurcated inlet, a center portion, and a bifurcated outlet, the bifurcated inlet coupled to the first exhaust outlet pipe and the second exhaust outlet pipe. In a fifth example of the exhaust system, optionally including one or more or each of the first through fourth examples, the bifurcated outlet is coupled to a first downstream outlet pipe and a second downstream outlet pipe, the first downstream outlet pipe terminating at a first tailpipe and the second downstream outlet pipe terminating at a second tailpipe. In a sixth example of the exhaust system, optionally including one or more or each of the first through fifth examples, the combined X-Y shaped intersection includes a Y-shaped portion comprising a bypass duct inlet coupled to the bypass duct, the bypass duct inlet leading to the center portion of the combined X-Y shaped intersection. In a seventh example of the exhaust system, optionally including one or more or each of the first through sixth examples, the combined X-Y shaped intersection includes a first lateral outer surface extending from a top surface of the combined X-Y shaped intersection to a bottom surface of the combined X-Y shaped intersection and a second lateral outer surface extending from the top surface to the bottom surface, and the first lateral outer surface includes a first concave curve having a first midpoint and the second lateral outer surface includes a second concave curve having a second midpoint. In an eighth example of the exhaust system, optionally including one or more or each of the first through seventh examples, each inlet of the bifurcated inlet is angled inward toward the center portion and each outlet of the bifurcated outlet is angled outward away from the center portion. In a ninth example of the exhaust system, optionally including one or more or each of the first through eighth examples, the bypass duct includes a straight portion and a curved portion, the straight portion extending from the muffler along a first axis parallel to a longitudinal axis of the muffler and the curved portion bending the bypass duct so that exhaust gas flowing through the bypass duct enters the combined X-Y shaped intersection along a second axis, substantially perpendicular to the first axis. In a tenth example of the exhaust system, optionally including one or more or each of the first through ninth examples, wherein the first exhaust outlet pipe and the second exhaust outlet pipe each include a respective straight portion extending from the muffler along the first axis and a respective curved portion, such that a center of the combined X-Y shaped intersection is positioned vertically above the first outlet of the muffler and the second outlet of the muffler. In an eleventh example of the exhaust system, optionally including one or more or each of the first through tenth examples, the curved portion of the bypass duct bends at a first angle and each respective curved portion of the first exhaust outlet pipe and the second exhaust outlet pipe bends at a second angle, the second angle smaller than the first angle. In a twelfth example of the exhaust system, optionally including one or more or each of the first through eleventh examples, the muffler includes a first inlet and a second inlet, and further comprising a first exhaust passage fluidly coupling an engine to the first inlet and a second exhaust passage fluidly coupling the engine to the second inlet. In a thirteenth example of the exhaust system, optionally including one or more or each of the first through twelfth examples, the exhaust system further includes an X-shaped intersection where the first exhaust passage and the second exhaust passage are fluidly coupled, the X-shaped intersection positioned upstream of the muffler.

Embodiments relate to a muffler including a first inlet configured to fluidly couple to a first exhaust passage of an engine; a second inlet configured to fluidly couple to a second exhaust passage of the engine; a first outlet configured to fluidly couple to a first exhaust outlet pipe; a second outlet configured to fluidly couple to a second exhaust outlet pipe; and a third outlet configured to fluidly couple to a bypass duct, where the first outlet and the second outlet are horizontally aligned and are each positioned vertically above the third outlet, and where the third outlet has a first diameter that is smaller than a second diameter of the first outlet and a third diameter of the second outlet. In a first example of the muffler, during a first mode of operation, all exhaust gas exiting the muffler travels through the third outlet, and during a second mode of operation, at least a portion of exhaust gas exiting the muffler travels through the first outlet and/or the second outlet. In a second example of the muffler, optionally including the first example, the muffler does not include any outlets other than the first outlet, the second outlet, and the third outlet.

Further embodiments provide for an exhaust system including a muffler; a first exhaust passage of an engine fluidly coupled to a first inlet of the muffler; a second exhaust passage of the engine fluidly coupled to a second inlet of the muffler; a first exhaust outlet pipe fluidly coupled to a first outlet of the muffler; a second exhaust outlet pipe fluidly coupled to a second outlet of the muffler; a bypass duct fluidly coupled to a third outlet of the muffler, the bypass duct having a first cross-sectional area that is smaller than a second cross-sectional area of the first exhaust outlet pipe and a third cross-sectional area of the second exhaust outlet pipe; and a combined X-Y shaped intersection comprising a bifurcated inlet fluidly coupled to the first exhaust outlet pipe and the second exhaust outlet pipe and a bypass duct inlet fluidly coupled to the bypass duct, where the bypass duct inlet is positioned vertically below the bifurcated inlet. In a first example of the exhaust system, the bifurcated inlet includes a first inlet and a second inlet each angled inward toward a center point of the combined X-Y shaped intersection, wherein the combined X-Y shaped intersection includes a bifurcated outlet comprising a first outlet and a second outlet each angled outward from the center point, wherein the bypass duct inlet is angled upward toward the center point, and wherein the bypass duct inlet is positioned horizontally intermediate the first inlet and the second inlet. In a second example of the exhaust system, optionally including the first example, the combined X-Y shaped intersection has an axis of symmetry at a central longitudinal axis of the combined X-Y shaped intersection.

FIGS. 1-12 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust system, comprising:

a muffler;

a first exhaust outlet pipe fluidly coupled to a first outlet of the muffler;

a second exhaust outlet pipe fluidly coupled to a second outlet of the muffler;

a bypass duct fluidly coupled to a third outlet of the muffler; and a combined X-Y shaped intersection at which the first exhaust outlet pipe, the second exhaust outlet pipe, and the bypass duct are fluidly coupled to each other.

2. The exhaust system of claim 1, wherein the first exhaust outlet pipe and the second exhaust outlet pipe each have a first cross-sectional area that is larger than a second cross-sectional area of the bypass duct.

3. The exhaust system of claim 1, wherein the first exhaust outlet pipe includes a first active exhaust valve coupled between the muffler and the combined X-Y shaped intersection and the second exhaust outlet pipe includes a second active exhaust valve coupled between the muffler and the combined X-Y shaped intersection.

4. The exhaust system of claim 1, wherein the bypass duct is free of any valves or restrictions.

5. The exhaust system of claim 1, wherein the combined X-Y shaped intersection includes an X-shaped portion comprising a bifurcated inlet, a center portion, and a bifurcated outlet, the bifurcated inlet coupled to the first exhaust outlet pipe and the second exhaust outlet pipe.

6. The exhaust system of claim 5, wherein the bifurcated outlet is coupled to a first downstream outlet pipe and a second downstream outlet pipe, the first downstream outlet pipe terminating at a first tailpipe and the second downstream outlet pipe terminating at a second tailpipe.

7. The exhaust system of claim 5, wherein the combined X-Y shaped intersection includes a Y-shaped portion comprising a bypass duct inlet coupled to the bypass duct, the bypass duct inlet leading to the center portion of the combined X-Y shaped intersection.

8. The exhaust system of claim 7, wherein the combined X-Y shaped intersection includes a first lateral outer surface extending from a top surface of the combined X-Y shaped intersection to a bottom surface of the combined X-Y shaped intersection and a second lateral outer surface extending from the top surface to the bottom surface, and the first lateral outer surface includes a first concave curve having a first midpoint and the second lateral outer surface includes a second concave curve having a second midpoint.

9. The exhaust system of claim 8, wherein each inlet of the bifurcated inlet is angled inward toward the center portion and each outlet of the bifurcated outlet is angled outward away from the center portion.

10. The exhaust system of claim 1, wherein the bypass duct includes a straight portion and a curved portion, the straight portion extending from the muffler along a first axis parallel to a longitudinal axis of the muffler and the curved portion bending the bypass duct so that exhaust gas flowing through the bypass duct enters the combined X-Y shaped intersection along a second axis, substantially perpendicular to the first axis.

11. The exhaust system of claim 10, wherein the first exhaust outlet pipe and the second exhaust outlet pipe each include a respective straight portion extending from the muffler along the first axis and a respective curved portion, such that a center of the combined X-Y shaped intersection is positioned vertically above the first outlet of the muffler and the second outlet of the muffler.

12. The exhaust system of claim 11, wherein the curved portion of the bypass duct bends at a first angle and each respective curved portion of the first exhaust outlet pipe and the second exhaust outlet pipe bends at a second angle, the second angle smaller than the first angle.

13. The exhaust system of claim 1, wherein the muffler includes a first inlet and a second inlet, and further comprising a first exhaust passage fluidly coupling an engine to the first inlet and a second exhaust passage fluidly coupling the engine to the second inlet.

14. The exhaust system of claim 13, further comprising an X-shaped intersection where the first exhaust passage and the second exhaust passage are fluidly coupled, the X-shaped intersection positioned upstream of the muffler.

15. A muffler, comprising:

a first inlet configured to fluidly couple to a first exhaust passage of an engine;

a second inlet configured to fluidly couple to a second exhaust passage of the engine;

a first outlet configured to fluidly couple to a first exhaust outlet pipe;

a second outlet configured to fluidly couple to a second exhaust outlet pipe; and a third outlet configured to fluidly couple to a bypass duct, where the first outlet and the second outlet are horizontally aligned and are each positioned vertically above the third outlet, and where the third outlet has a first diameter that is smaller than a second diameter of the first outlet and a third diameter of the second outlet.

16. The muffler of claim 15, wherein, during a first mode of operation, all exhaust gas exiting the muffler travels through the third outlet, and during a second mode of operation, at least a portion of exhaust gas exiting the muffler travels through the first outlet and/or the second outlet.

17. The muffler of claim 15, wherein the muffler does not include any outlets other than the first outlet, the second outlet, and the third outlet.

18. An exhaust system, comprising:

a muffler;

a first exhaust passage of an engine fluidly coupled to a first inlet of the muffler;

a second exhaust passage of the engine fluidly coupled to a second inlet of the muffler;

a first exhaust outlet pipe fluidly coupled to a first outlet of the muffler;

a second exhaust outlet pipe fluidly coupled to a second outlet of the muffler;

a bypass duct fluidly coupled to a third outlet of the muffler, the bypass duct having a first cross-sectional area that is smaller than a second cross-sectional area of the first exhaust outlet pipe and a third cross-sectional area of the second exhaust outlet pipe; and a combined X-Y shaped intersection comprising a bifurcated inlet fluidly coupled to the first exhaust outlet pipe and the second exhaust outlet pipe and a bypass duct inlet fluidly coupled to the bypass duct, where the bypass duct inlet is positioned vertically below the bifurcated inlet.

19. The exhaust system of claim 18, wherein the bifurcated inlet includes a first inlet and a second inlet each angled inward toward a center point of the combined X-Y shaped intersection, wherein the combined X-Y shaped intersection includes a bifurcated outlet comprising a first outlet and a second outlet each angled outward from the center point, wherein the bypass duct inlet is angled upward toward the center point, and wherein the bypass duct inlet is positioned horizontally intermediate the first inlet and the second inlet.

20. The exhaust system of claim 18, wherein the combined X-Y shaped intersection has an axis of symmetry at a central longitudinal axis of the combined X-Y shaped intersection.

* * * * *